US006172941B1

(12) United States Patent
Bieramperl

(10) Patent No.: US 6,172,941 B1
(45) Date of Patent: Jan. 9, 2001

(54) METHOD TO GENERATE SELF-ORGANIZING PROCESSES IN AUTONOMOUS MECHANISMS AND ORGANISMS

(75) Inventor: Erich Bieramperl, Linz (AT)

(73) Assignee: Sensor Timing GmbH, Linz (AT)

( * ) Notice: Under 35 U.S.C. 154(b), the term of this patent shall be extended for 0 days.

(21) Appl. No.: 09/464,178

(22) Filed: Dec. 16, 1999

(51) Int. Cl.[7] ..... G04B 47/00; G05B 19/04; G05B 19/18

(52) U.S. Cl. ..... 368/10; 700/251; 700/253

(58) Field of Search ..... 368/10; 356/307, 356/372, 375, 376; 700/32, 250–254

(56) References Cited

U.S. PATENT DOCUMENTS 4,450,530 * 5/1984 Llinias et al. ..... 364/513
5,442,510 * 8/1995 Schwartz et al. ..... 364/157
5,666,202 * 9/1997 Kyrazis ..... 365/372

* cited by examiner

*Primary Examiner*—Vit Miska
(74) *Attorney, Agent, or Firm*—Herbert Dubno

(57) ABSTRACT

A method to generate recognition, auto-adaptation and self-organization in autonomous mechanisms and organisms. A number of sensing elements generate analog signals whose amplitudes are classified into different classes of perception intensity. The currently occurring elapse times between phase transitions are recorded and compared with prior recorded elapse times in order to find covariant time sequences and patterns. A motion actuating system can be coupled to the assembly, which is controlled by pulse sequences that have been modulated in accordance with the covariant time sequences. In this way the mechanism or organism in motion is prompted to emulate the found covariant time sequences, while being able to recognize its own motion course and adapting itself to changes of environment.

Figure 1:
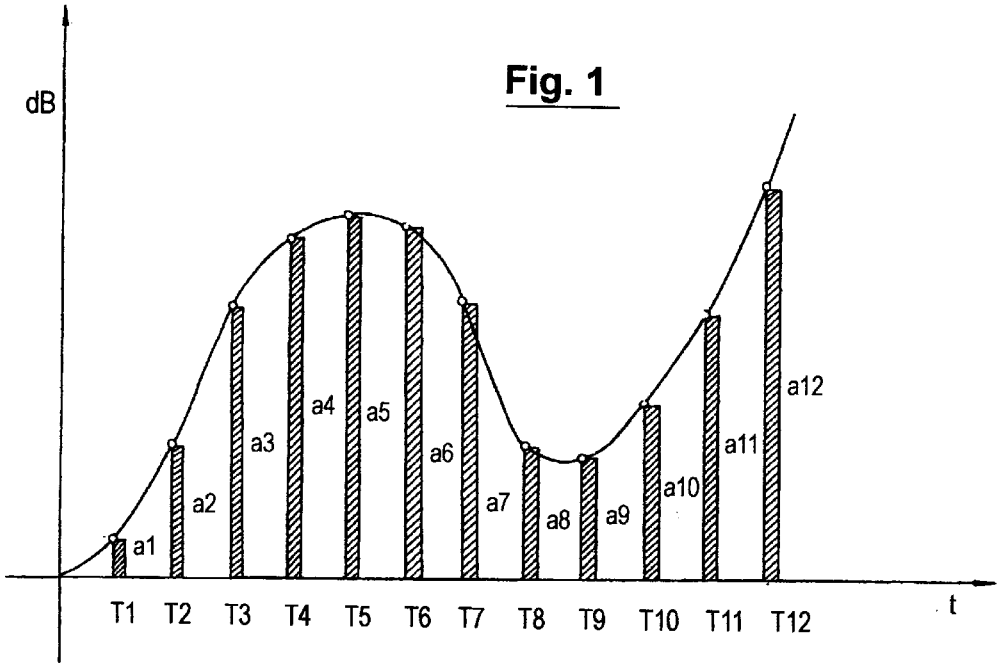

11 Claims, 16 Drawing Sheets dB
a1
a2
a3
a4
a5
a6
a7
a8
a9
a10
a11
a12
T1
T2
T3
T4
T5
T6
T7
T8
T9
T10
T11
T12
t

4
Q
source
c
3
2
sensors
move direction
S1
S2
b
V
W
dB
P5
P4
P3
P2
P1
0
1
Tv(4)
4.2
Tv(5)
4.1
4.2
4.1
3.1
Tv(3)
3.1
3.2
Tv(6)
3.2
2.1
Tv(2)
2.1
2.2
Tv(7)
2.2
iT(1.1)
1.1
V
W
Tv(1)
iT(nnn...)

mV
t(tot)
16
14
15
13b
13a
P3
P2
19
18
17
16a
16b
13
12
P1
P0
-100mV
STQ(v)
t(P3)
t(P2)
t(P1)
t
12a
b
c Td(1)-Td(2)-Td(3)-Tw(4)-Td(4)
t(P1)
t(P2)
t(P3)
t(P4)
v'
a'
b'
P1
P2
P3
P4
zone 1
zone 2
zone 3
zone 4
vap
vm
g
20
21
22
23
24
25
26
27
28
29
30
30a
31 vap(1..5)
vap
vm
g1
g2
g3
g4
g5
gt
m'
a'

MEMORY A
recognition signal
MEMORY B
109
110
112
111
STQ-data-acquis.
current Tω-Tδ time data
analyzer
referent Tω-Tδ time data
REFERENCE DATA INPUT
113
corrector
b
105
S1
104
S2
zone 1
zone 2
zone 3
106
(iT)
A
B
C
D
E
F
G
H
108
107
move direction
d1
d2
d3
d4
d5
d6
d7 sensitivity
dB
zone 3
zone 2
zone 1
P3
P2
P1
(iT) A
(iT) B
(iT) C
(iT) D
(iT) E
(iT) F
(iT) G
(iT) H
iT (nnn...)
d1
d2
d3
d4
d5
d6
d7

| iT | Vm (mm/s) | $f$ scan Hz |
|---|---|---|
| A | 1000 | 10 000 |
| B | 1000 | 10 000 |
| C | 1000 | 10 000 |
| D | 1000 | 10 000 |
| E | 1000 | 10 000 |
| F | 1000 | 10 000 |
| G | 1000 | 10 000 |
| H | 1000 | 10 000 |

| distance | | STQ(v) (cs) | STQ(d) (cs) | distance | | STQ(v) (cs) | STQ(d) (cs) |
|---|---|---|---|---|---|---|---|
| d1 | AB | 200 | 27 3 | d7 | AH | 200 | 220 0 |
| d2 | BC | 200 | 27 3 | d6 | BG | 200 | 187 6 |
| d3 | CD | 200 | 73 8 | | | | |
| d4 | DE | 200 | 62 0 | | | | |
| d5 | EF | 200 | 26 2 | | | | |

Fig. 6e
| iT | Vm mm/s | *f*scan Hz |
|---|---|---|
| A | 1000 | |
| B | 985 | 9 850 |
| C | 970 | 9 700 |
| D | 930 | 9 300 |
| E | 820 | 8 200 |
| F | 750 | 7 500 |
| G | 720 | 7 200 |
| H | 690 | 6 900 |
| distance | | STQ(v) (cs) | STQ(d) (cs) | distance | | STQ(v) (cs) | STQ(d) (cs) |
|---|---|---|---|---|---|---|---|
| d1 | AB | 200 | 27\|3 | d7 | AH | 200 | 220\|0 |
| d2 | BC | 200 | 27\|3 | d6 | BG | 200 | 187\|6 |
| d3 | CD | 200 | 73\|8 | | | | |
| d4 | DE | 200 | 62\|0 | | | | |
| d5 | EF | 200 | 26\|2 | | | | |
Fig. 7a
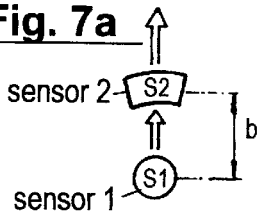
Fig. 7b
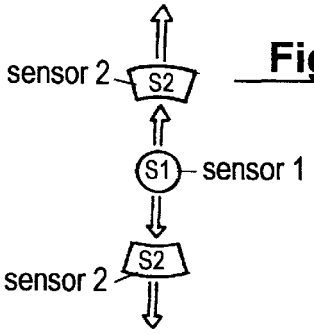
Fig. 7c
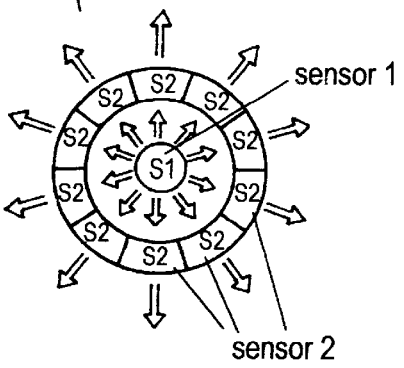
Fig. 7d
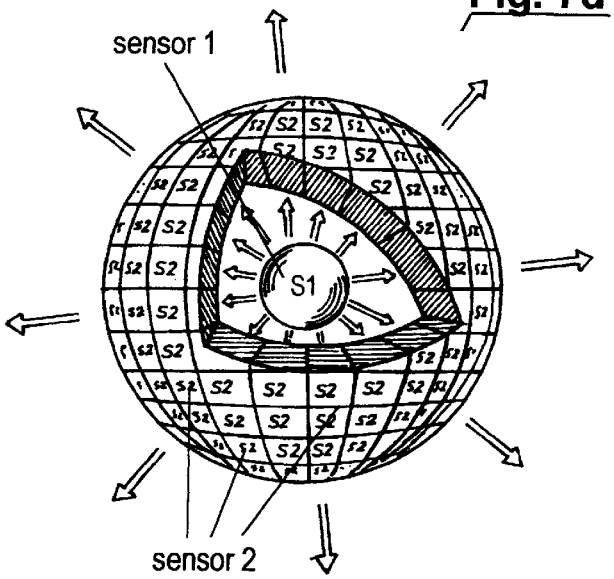

METHOD TO GENERATE SELF-ORGANIZING PROCESSES IN AUTONOMOUS MECHANISMS AND ORGANISMS

BACKGROUND

This invention describes a method for generating processes that facilitate the self-organization of autonomous systems. It can be applied to mechanistic fields as well as to molecular/biological systems. By means of the invention described herein, it is possible for a system in motion to recognize external events in a subjective way through self-observation; to identify the surrounding physical conditions in real time; to reproduce and to optimize the system's own motions; and to enable a redundancy-poor process that leads to self-organization.

Robot systems of the usual static type are mainly based on deterministic path dependent regulating processes. The digital outputs and values that control the robot's position are stored in the memory of a central computer. Many degrees of freedom can be created by a suitable arrangement of coordinating devices. Position detectors can be devices such as tachogenerators, encoders, or barcode rulers scanned by optical sensors that provide path dependent increment pulses. The activation mostly takes place by means of stepper motors.

It is also well-known that additional adaptive regulating processes based on discrete time data are used in path dependent program control units. These data are produced by means of the SHANNON quantization method, utilizing analog-to-digital converters to sample the amplitudes of sensors and transducers. They serve to identify the system's actual value (i.e. its current state). Continued comparison of reference values and actual values are necessary for correction and adjustment of the regulating process. Newly calculated parameters are then stored in the memory. This kind of adaptive regulation is necessary, for example, in order to eliminate a handling robot's deviations from a preprogrammed course that are caused by variable load conditions.

If a vehicle that is robot-controlled in this way were to be placed into an autonomous state, it would generally be impossible to determine its exact position reference (i.e. coordinates) by means of tachogenerators or encoders. For this reason controlling values (or commands) cannot be issued by a computer—or preprogrammed into a computer—in an accurate manner. This is true not only for robot-controlled automobiles, gliding vehicles, hovercraft or aircraft, but also for rail-borne vehicles for which the distance dependent incremental pulses are often inaccurate and therefore not reproducible. This is usually caused by an uneven surface or worn or slipping wheels. Explorer robots, which are used to locate objects or to rescue human beings from highly inaccessible or dangerous locations, must therefore be controlled manually, or with computer supported remote control units. A video communication system is necessary for such cases in order to be able to monitor the motion of the robot. However, in many applications of robotics, this is inadequate. A robot-controlled automobile, for example, should be capable of avoiding dangerous situations in real time, as well as being capable of adapting its speed to suit the environment, without any human intervention. In such cases, it is necessary for the on-board computer to recognize the situation at hand, then calculate automatically the next steps to be carried out. In this way the robot-controlled vehicle ought to have a certain capability for self-organization. This is also true for other robot-controlled systems.

With regards to autonomous robot systems, techniques already exist to scan the surroundings by means of sensors and to analyze the digital sensor data that were acquired using the above-mentioned discrete time quantization method (see FIG. 1); and there already exist statistical calculation methods and algorithms that generate suitable regulating parameters. Statistical methods for handling such regulating systems were described in 1949 by Norbert WIENER. According to the SHANNON theorem, the scanning of the external environment must be done with at least double the frequency of the signal amplitude bandwidth. In this way the information content remains adequate. In order to be able to identify the robot's own motions, very high sampling rates are necessary. This amplitude quantization method currently in widespread use requires the correlation of particular measurement data to particular points in time (Ts) that are predetermined using the program counter. For this reason this should be understood as a deterministic method. However, practical experience has shown that even ultrahigh-speed processors and the highest sampling rates cannot provide sufficient efficiency. The number of redundant data and the amount of computing operations increase drastically when a moving sensor-controlled vehicle meets new obstacles or enters new surroundings at variable speed. Indeed, C. SHANNON's quantization method does not allow recognition of an analogue signal amplitude in real time, especially if there are changing physical conditions or variable motions for which the acquisition of additional information regarding the instantaneous velocity is necessary. This is also true if laser detectors or supersonic sensors are used, for which mainly distance data are acquired and processed. Therefore, although this quantization method is suitable for analyzing the trace of a motion and for representing this motion on a monitor (see Pat. AT 397 869), it is hardly adequate for recognizing the robot's own motion, or for reproducing it in a self-adaptive way.

Some autonomous mobile robot systems operate with CCD sensors and OCR software (i.e. utilising image processing). These deduce contours or objects from color contrast and brightness differentials, which are interpreted by the computer as artificial horizons or orientation marks. Examples of this technology are computer-supported guidance systems and steering systems that allow vehicles to be guided automatically by centre lines, side planks, street edges and so on. CCD sensors—when one observes how they operate—are analog storage devices that function like well-known bucket brigade devices. Tightly packed capacitors placed on a MOS silicon semiconductor chip are charged by the photoelectric effect to a certain electrical potential. Each charge packet represents an individual picture element, termed "pixel"; and the charge of each pixel is a record of how bright that part of the image is. By supplying a pulse frequency, the charges are shifted from pixel to pixel across the CCD, where they appear at the edge output as serial analog video signals. In order to process them in a computer, they must be converted into digital quantities. This requires a large number of redundant data and calculations; this is why digital recording of longer image sequences necessitates an extremely large high speed memory. Recognizing isomorphous sequences in repetitive motions is only possible with large memory and time expenditure, which is why robotic systems based on CCD sensors cannot adequately reproduce their own motion course in a self-adaptive way. With each repetition of the same motion along the same route, all regulating parameters must be calculated by means of picture analysis anew. If environment conditions change through fog, darkness or snowfall, such systems are overburdened. Pat. AT 400 028 describes a system for the adaptive regulation of a motor driven vehicle, in which certain landmarks or signal sources are provided along the vehicle's route in order to serve as bearing markers that allow the robot to keep to a schedule. Positions determined by GPS data can also serve this purpose. When the system passes these sources, the sensor coupled on board computer acquires the elapsed times for all covered route segments by means described in U.S. Pat. No. 4,245,334, which details the manner of time quantization by first and second sensor signals The data acquired in this way serve as a reference base for the computation of regulating parameters that control the drive cycles and brake cycles of the vehicle when a motion repetition happens. The system works with low data redundancy, corrects itself in a self-adaptive manner, and is capable of reproducing an electronic route schedule precisely. It is suitable, for example, for ensuring railway networks keep to schedule. However, in the system detailed in the above-mentioned patent, it is not possible to identify external objects and surroundings.

It is an object of the present invention to provide an extensive method for the creation of autonomous self-organizing robot systems or organisms, which enables them to identify external signals, objects, events, physical conditions or surroundings in real time by observing from their own subjective view. They will be able to recognize their own motion patterns and to reproduce and optimize their behavior in a self-adaptive way. Another object of this invention is the preparation of an autonomous training robot for use in sports, that is capable of identifying, reproducing and optimizing a motion process (e.g. that has been trialed beforehand by an athlet) as well as: determining the ideal track and speed courses automatically; keeping to route schedules; representing its own motion, speeds, lap times, intermediate times and start to finish times on a monitor; and which is capable of acoustic or optical output of the acquired data.

SUMMARY OF THE INVENTION

The requirements outlined in the previous paragraph are solved generically by attaching analog sensors or receptors onto the moving system (for example, a robot system) which scan surrounding signal sources whose amplitudes are subdivided by defining a number of threshold values. This creates perception zones. The elapsed times of all phase transitions in all zones are measured by means of analog or digital STQ quantization, and the frequency of the time pulses is modulated automatically, depending on the relative instantaneous speed which is determined by the phase displacement of equivalent sensors. Therefore the counted time pulses correlate approximately with the length-values d(nnnn).

With this method, the scanning of signal amplitudes is not a deterministic process: it is not carried out at predetermined times with predetermined time pulses. The recording, processing and analysis of the elapsed times takes place according to probabilistic principles. As a result, a physically significant phenomenon arises: the parameters describing the external surroundings are not objectively measured by the system, but are subjectively sensed as temporal sequences. The system itself functions as observer of the process. In the technical literature—in the context of deterministic timing—elapse times are also-called "signal running times" or "time intervals ". According to the present invention, the so-called STQ elapse times in a signal-recognition process are quantized with every transition of a phase amplitude through a threshold value (which is effected by starting and stopping a number of timers). This produces a stream of time data. Every time elapsed between phase transitions in the "equal zone", as well as the time elapsed between transitions through a low threshold value then a higher threshold value (and vice versa), can be recorded.

The present invented method differentiates between three prnciples of STQ quantization (or, respectively, elapse time measurements):

STQ(*v*)=sensitivity/time quantum of velocity=Tv1,2,3 . . .

This is the elapsed time determined by the signal amplitude that occurs when a first sensor (or receptor) S2 and an equivalent second sensor (or receptor) S1 moves along a corresponding external signal source Q, measured from the rising signal edge at the phase transition iTv1.1 of the first sensor signal to the rising signal edge at the phase transition iTw1.1 of the second sensor signal; and likewise from iTv2.1 to iTw2.1, from iTv3.1 to iTw3.1. (These transitions correspond to equivalent threshold values P1,2,3 . . . ) STQ(v) times can also be measured from falling signal edges. They serve as parameters for the immediate relative velocity (vm) of the system in motion.

STQ(*i*)=sensitivity/time quantum of interarrival=Tw1,2,3 . . .

This is the elapsed time determined by the signal amplitude of a sensor (or receptor) S in the field of a corresponding external signal source Q; and/or determined by the signal amplitude of a sensor (or receptor) S that is moving along several equivalent external signal sources Q1,2,3 . . . This elapsed time is measured from the rising signal edge at the phase transition iTw1.1 to the falling signal edge at the phase transition iTw1.2, likewise from the rising edge at iTw2.1 to the falling edge at iTw2.2, and from the rising edge at iTw3.1 to the falling edge at iTw3.2 etc.; or, equivalently, from the falling signal edge at the phase transition iTw1.2 to the rising signal edge at the phase transition iTw1.3; and from the falling edge at iTw2.2 to the rising edge at iTw2.3, from the falling edge at iTw3.2 to the rising edge at iTw3.3, and so on (These transitions correspond to the equivalent threshold values P1,2,3 . . . ). If the time counting frequency for the STQ(i)-quantized elapse times Tw(1,2,3 . . . n) is modulated in proportion to the immediate relative speed vm (which is detected by means of STQ(v) parameters), then the counted time pulses correlate to the relative distances through which the sensor coupled system is moving. Therefore, of course, the adapted elapse times are not identical to real physical measured times that would have been acquired from those relative lengths by usual timers. However, with absolute physical invariance between the system in motion and the surroundings (i.e. synchronism), no STQ parameter can be acquired.

STQ(i d)=sensitivity/time quantum of differentiation=Td1,2,3 . . .

This is the elapsed time determined by the signal amplitude of a sensor (or receptor) S within range of a corresponding external signal source (Q1,2,3 . . . ), measured from the rising signal edge at the phase transition iTw1 of a rising amplitude trace to the rising signal edge at the next higher phase transition iTw2, and from the rising edge at iTw2 to the rising edge at iTw3, from the rising edge at iTw3 to the rising edge at iTw4, and so on; or, equivalently, from successive falling edges when amplitude traces are falling. (These transitions correspond to the equivalent threshold values P1,2,3,4 . . . ) STQ(d) elapse times are differentiation parameters for the slope of signal amplitudes (and consequently for their frequency); furthermore they serve as a plausibility check and verification of other corresponding STQ data. With this measurement, the relative motion between sensor and signal source is not taken into account.

In the case of no relative motion between sensors and sources, changes in the source field are detectable and recognizable by recording STQ(i) and/or STQ(d) data. If the source field is invariant, a recognition is only possible if STQ(i) or STQ(v)-data are derived from variable threshold values (focusing). If there is absolute physical invariance, no STQ-quantum can be acquired, and recognition is impossible. STQ(v) data are recorded in order to recognize the spatial surroundings under relative motion, and/or to identify relative motion processes so as to be able to recognize the self-motion (or components of this motion); as well as to reproduce any motion in a self-adaptive manner.

If the method presently being described is applied in a mechanistic area, the above-mentioned perception area zones may normally be set by a number of electronic threshold value detectors with pre-definable threshold levels, and the STQ(i) and STQ(d) elapse time data are acquired by programmable digital timers. The elapse timing process is actuated at an iT phase transition as well as halted at an iT phase transition. Then the time data are stored in memory.

Moreover, these STQ(v) elapse times are recorded by means of electronic integrators, in which the charge times of the capacitors determine those potentials that are applied as analog STQ(v) data to voltage/frequency converters, in order to modulate the digital time pulse frequencies for the adaptive measurement of STQ(i) and STQ(d) data, in a manner which is a function of the relative speed vm.

In non-mechanistic implementations of the method presently being described, it is intended that the so-called perception area zones, as well as the threshold value detectors and the previously described STQ-quantization processes, are not formed in the same manner as in electronic analog/digital circuits, but in a manner akin to molecular/biological structures.

In other general implementations, it is intended that those time stream patterns that consist of currently recorded STQ data be continuously compared with prior recorded time stream patterns by means of real time analysis, in order to identify external events or changes in physical surroundings with a minimum of redundancy, as well as to recognize these in real time.

In yet another possible general implementation, it is intended that autonomously moving systems, that are equipped with sensors and facilities capable of the kind of time stream pattern recognition mentioned above, have propulsion, steering and brake mechanisms that are regulated in such a manner, that the autonomously moving system (in particular, a mobile robot system) is capable of reproducing prior recorded STQ time stream patterns in a self-adaptive way. When repeating this movement, a processor deletes unstable or insufficiently co-ordinated time stream data from memory, while assigning only those time stream data as instruction, which allows reproduction of the motion along the same routes in an optimal co-ordinated manner.

In addition, it is intended that the time base frequency for the above mentioned STQ elapse timing is increased or decreased in order to scale the time sequences proportionally, whereby the velocity of all movements is proportionally scaled too.

Finally, it is intended to focus the perception zones defined by threshold values, in order to facilitate recognition of invariant source fields and/or to ensure that motion courses are repeated uniformly, if convergence cannot be achieve sufficiently often. (This is object of an additional patent application).

SHORT DESCRIPTION OF THE FIGURES

FIG. 1 shows a diagram of SHANNON's deterministic method of discrete time quantization of signal amplitude traces.

Figure 2A:
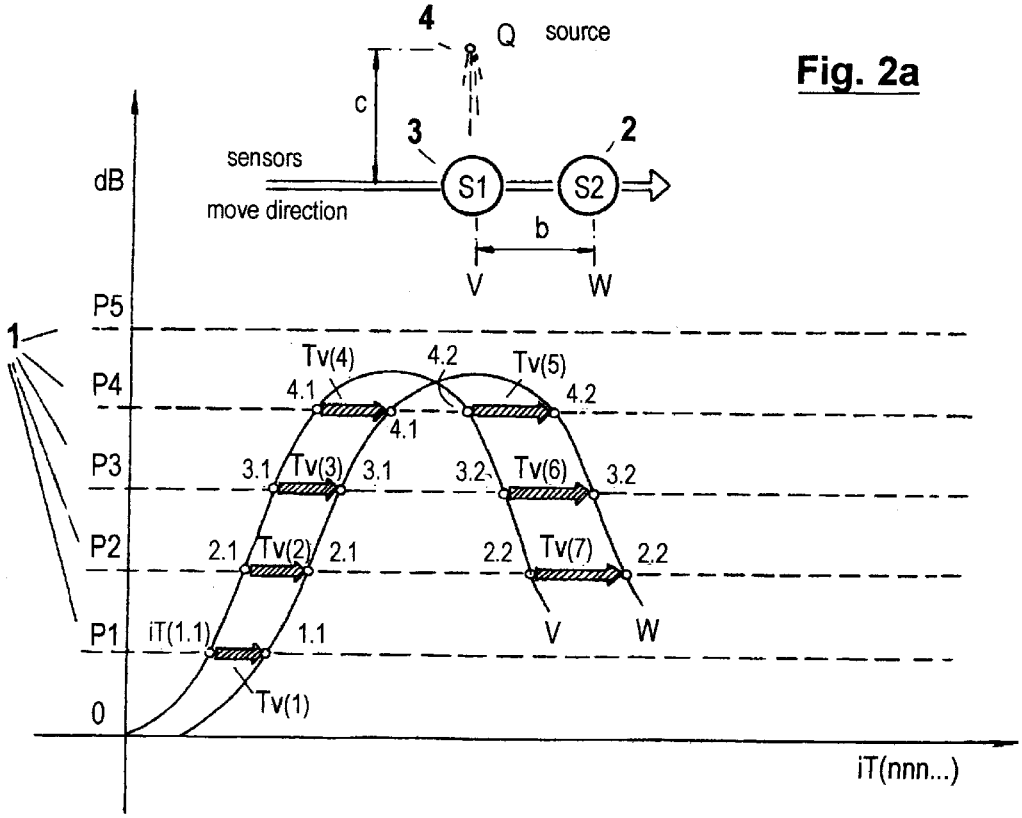
Figure 2B:
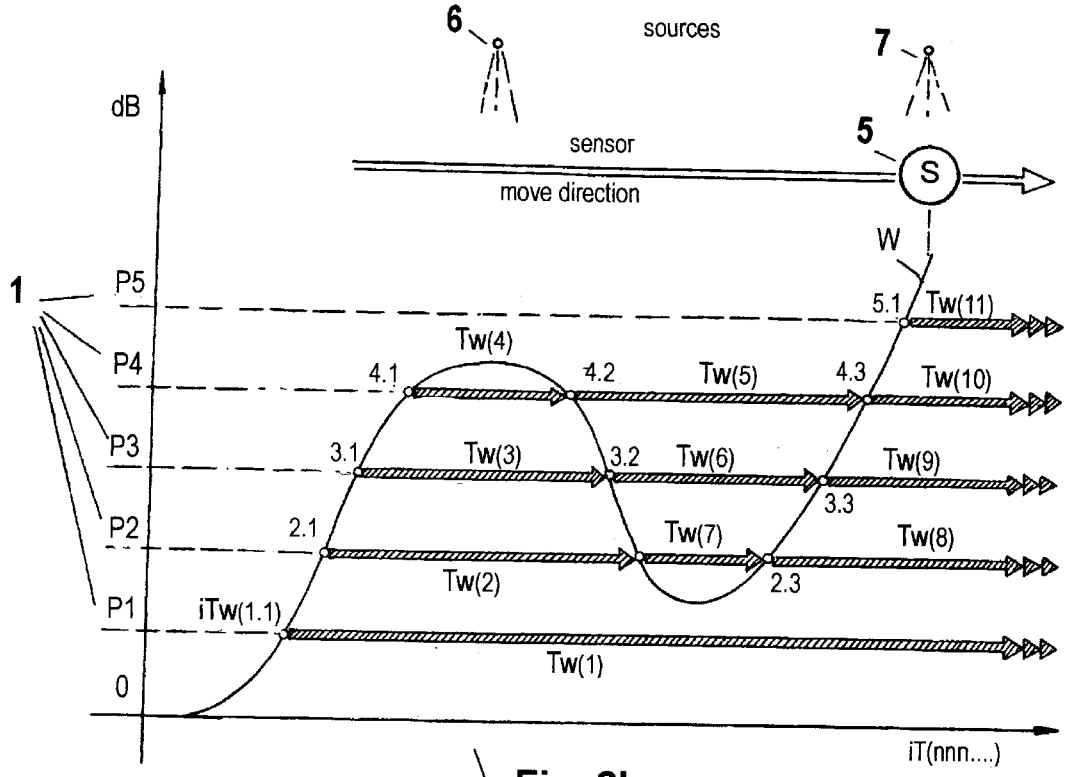
Figure 2C:
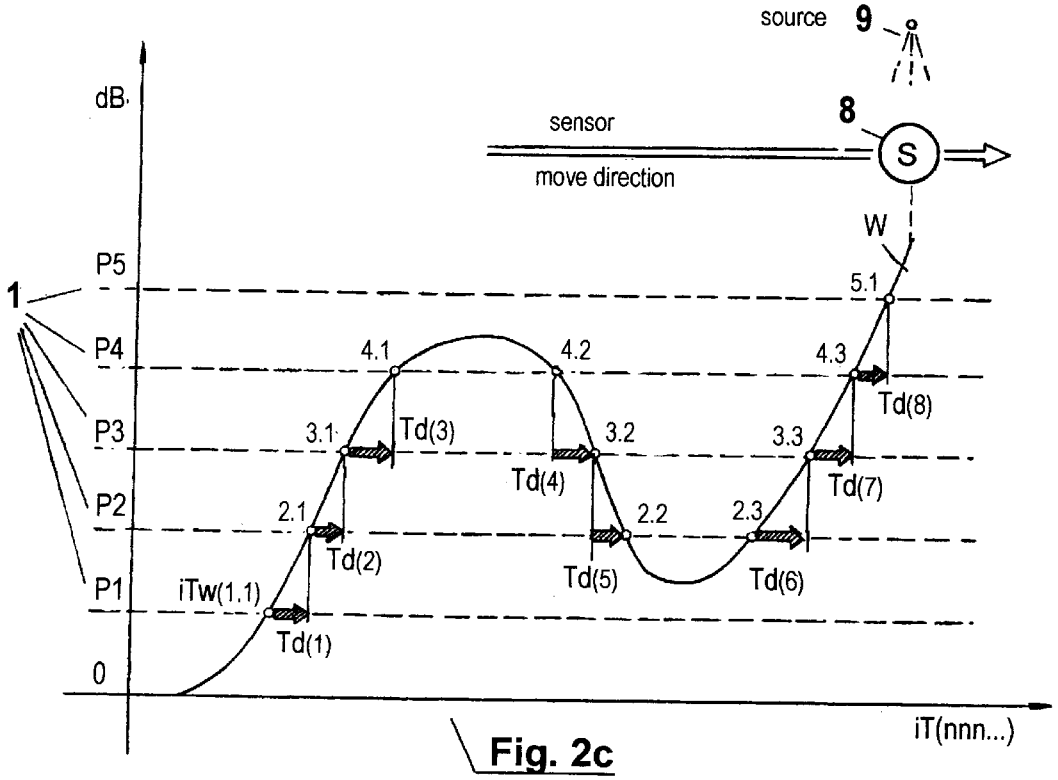
Figure 3:
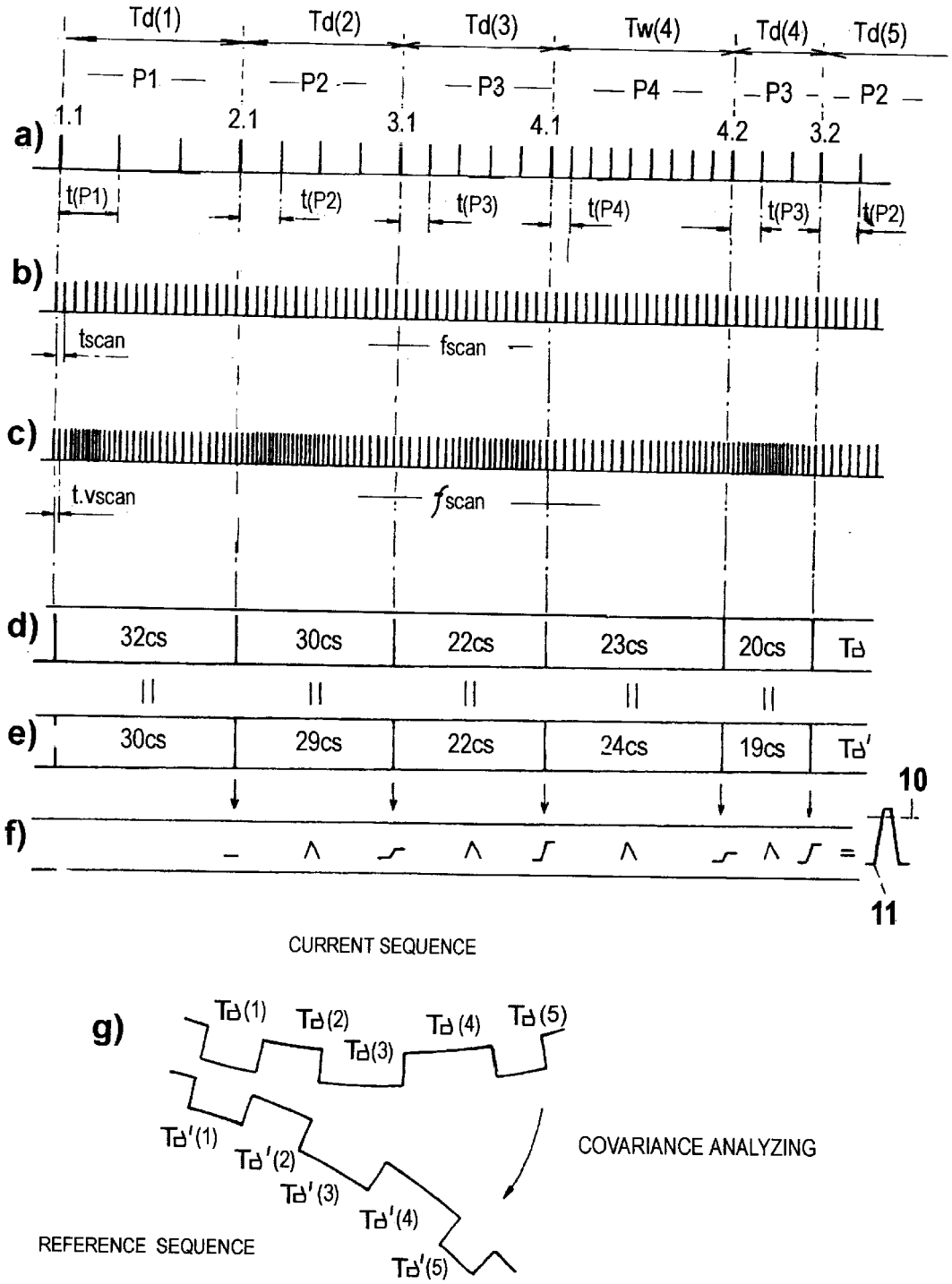

FIGS. 2*a–c* are graphic diagrams of the quantization of signal amplitude traces by means of acquisition of STQ(v), STQ(i) and STQ(d) elapse times, according to the herein described non-deterministic method FIGS. 3*a–c* illustrate this non-deterministic quantization method in connection with serial transfer of acquired STQ (d)-elapse times, as well as time pulse frequency modulation of simultaneously acquired parameters of the immediate relative speed (vm).

FIGS. 3*d–g* illustrate, in accordance with the presently described invention, a method to compare the currently acquired STQ time data sequences with prior recorded STQ time data sequences, in order to detect isomorphism of certain time stream patterns.

Figures 4A, 4B:
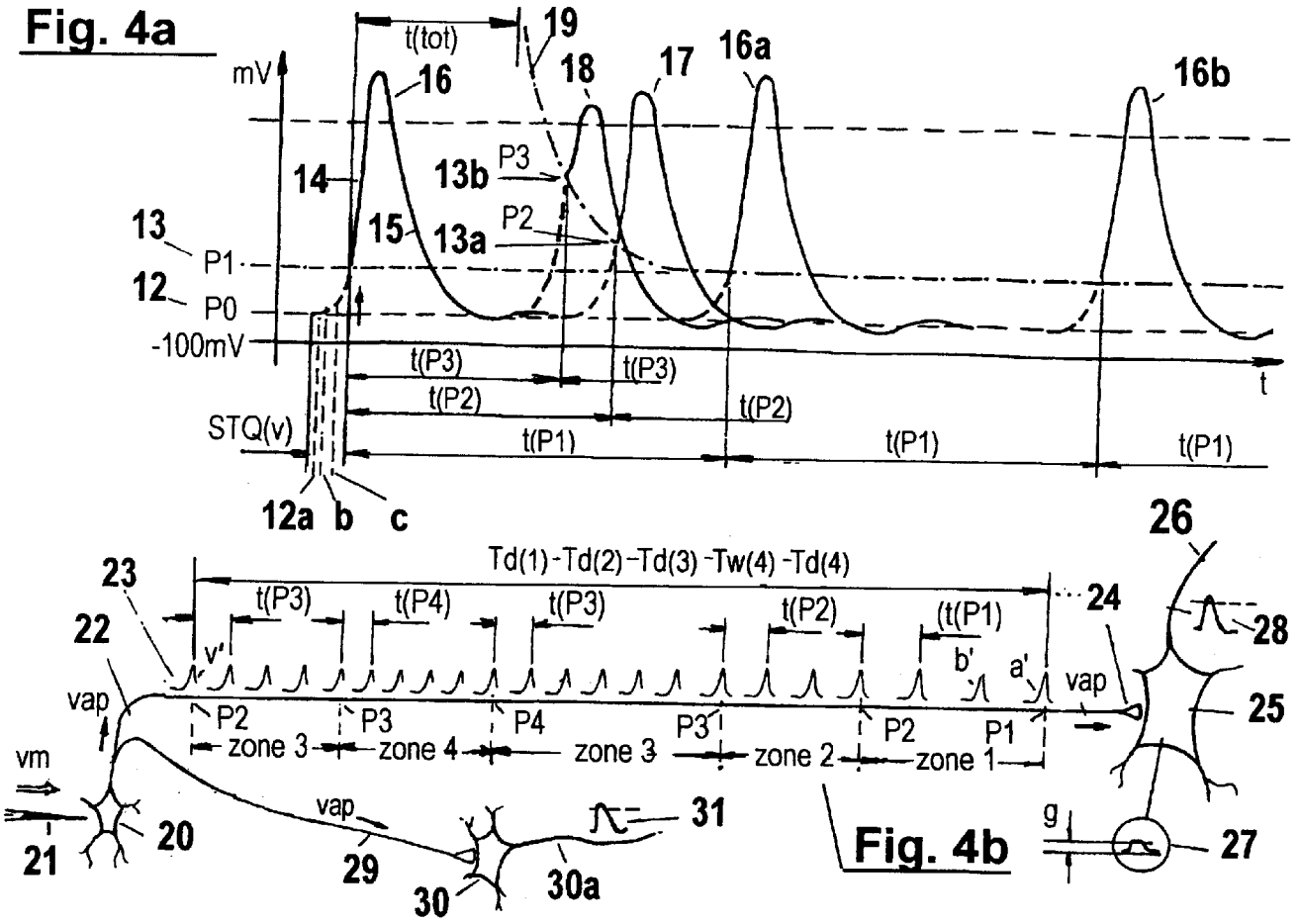

FIG. 4*a* shows an action potential AP.

FIG. 4*b* shows vm dependent action potentials which propagate from a sensory neuron (receptor) along a neural membrane to the synapse where the covariance of STQ sequences is analysed.

Figures 4C, 4D, 4E, 4F:
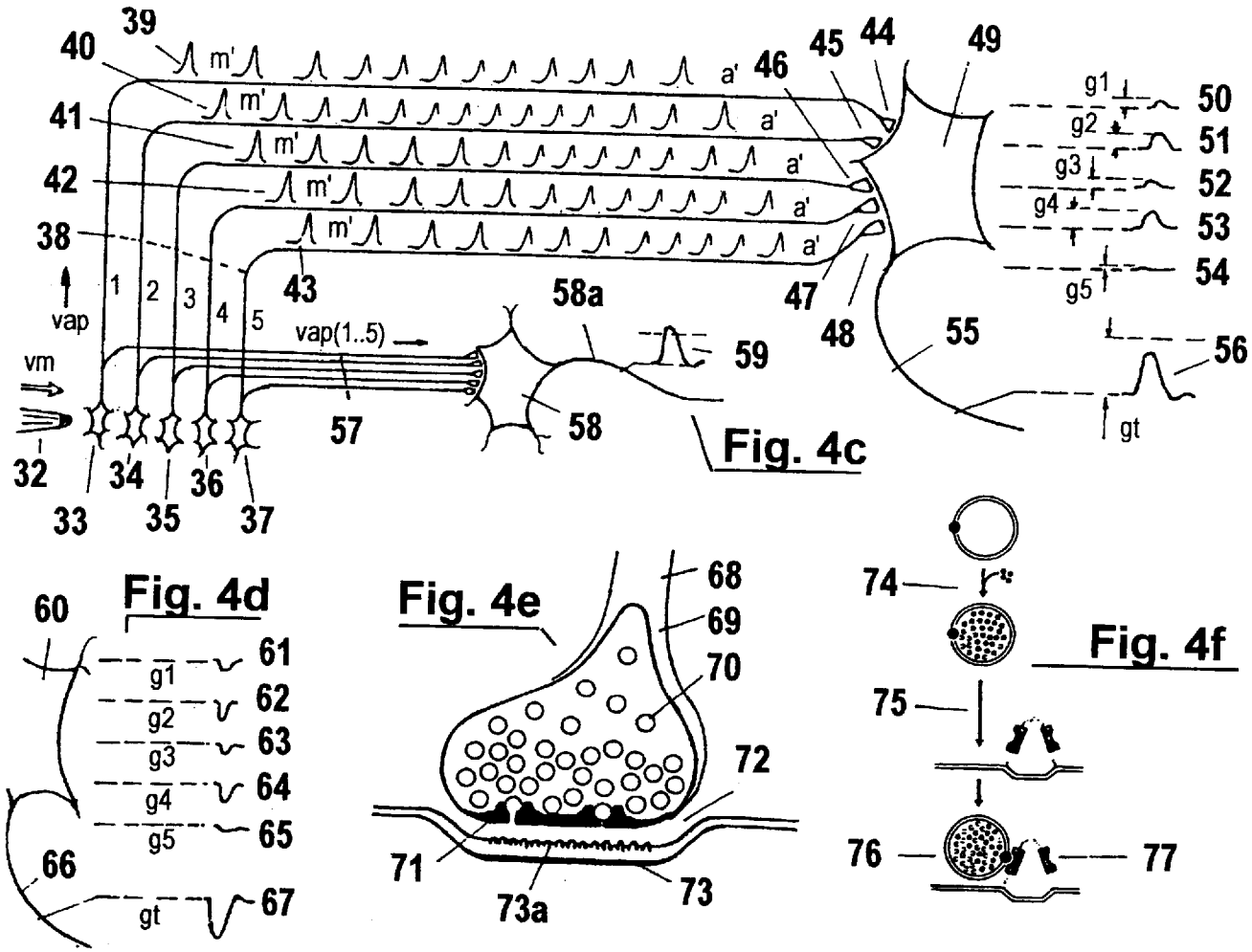

FIG. 4*c* shows a number of vm dependent action potentials, which propagate from a group of suitable receptors along collateral neural membranes to synapses, at which the "temporal and spatial facilitation" of AP's is analysed together with the covariances of these STQ sequences in order to recognize a complex perception.

FIG. 4*d* shows a postsynaptic neuron that produces potentials with inhibitory effects.

FIG. 4*e* and FIG. 4*f* show the general function of the synaptic transfer of molecular/biologically recorded STQ information to other neurons or neuronal branches.

Figure 5:
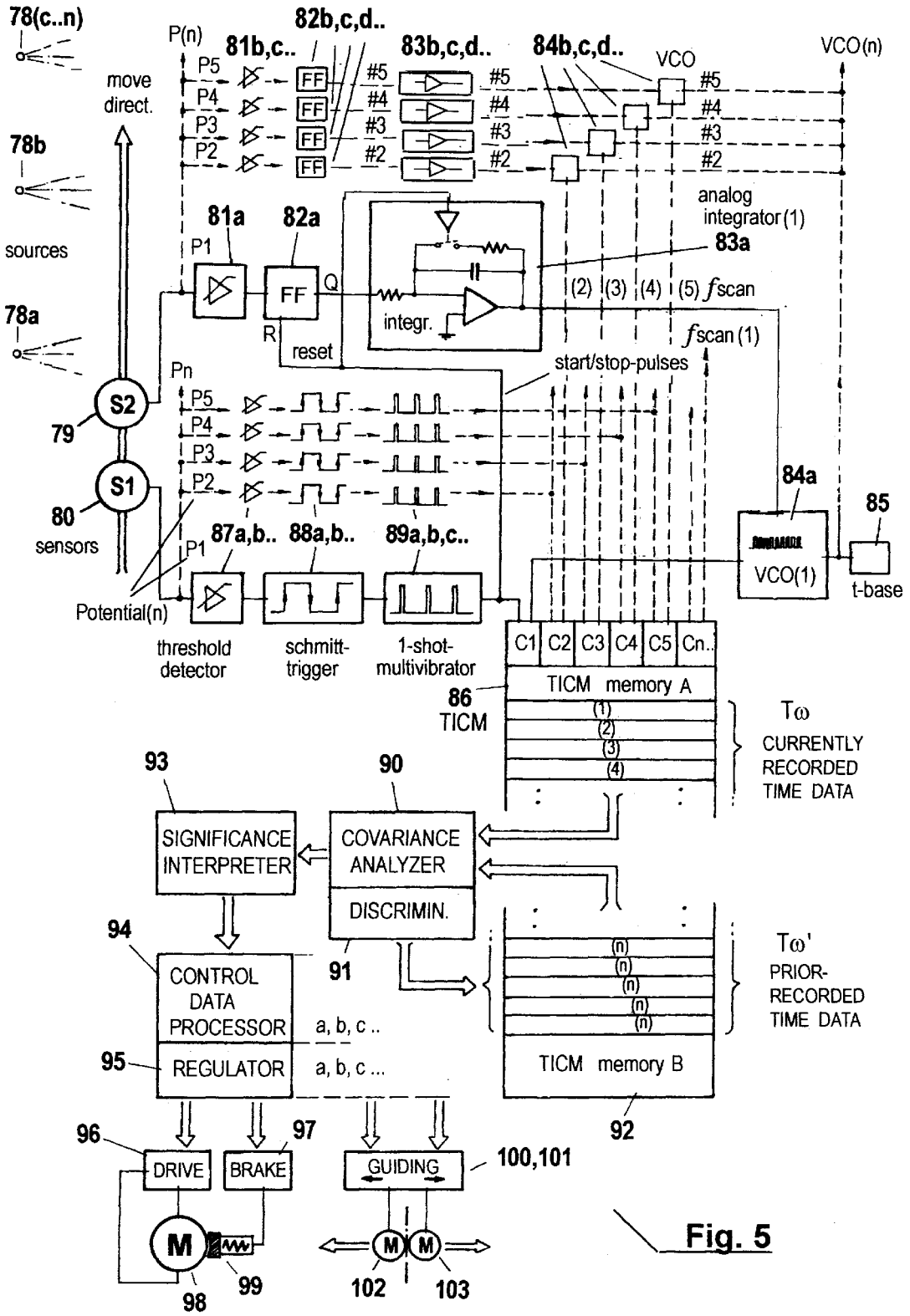

FIG. 5 shows a configuration where the described invented method has been applied to generate an autonomous self-organizing mechanism, and where the STQ time data are acquired by means of electronics.

Figure 6A:
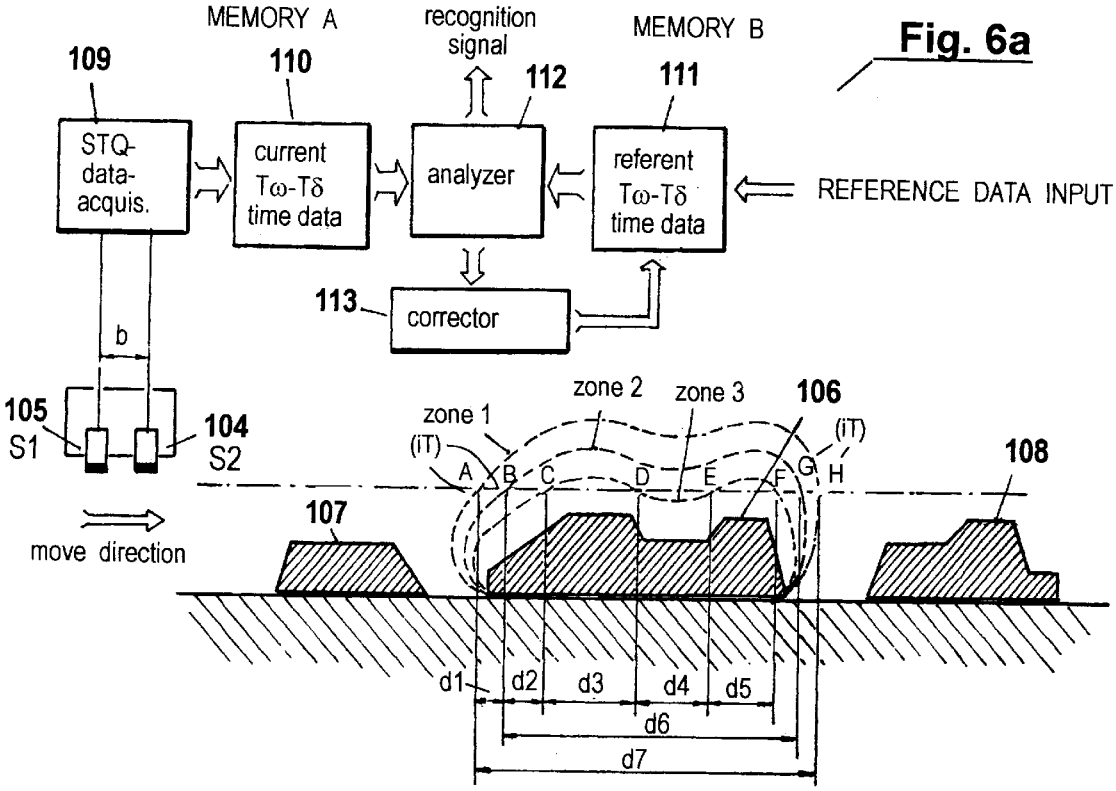

FIG. 6*a* shows a configuration of a concrete embodiment of the present method, where (as in FIGS. 2*a*–2*c*) the acquired STQ(v), STQ(i) and STQ(d) time data are applied to the recognition of certain spatial profiles, structures or objects when the system is in motion at arbitrary speed.

FIGS. 6*b–e* illustrate several diagrams and schedules in accordance with the particular embodiment in FIG. 6*a,* in which the sensory scanning and recognition of certain profiles can occur under invariable or variable speed course conditions.

FIGS. 7*a–d* show several configurations of sensors and sensor structures for the recording of STQ(v) elapse times, which serve as parameters of the immediate relative velocity vm.

FIGS. 8*a–f* illustrate a configuration, as well as the principles under which another embodiment of the invention functions, in which the acquisition of STQ time data (see FIGS. 2*a*–2*c*) is used to create an autonomous self-adaptive and self-organizing training robot for use in sport. This embodiment is capable of reproducing and optimizing motion processes that have been pre-exercised by the user.

It is also capable of determining the ideal track and speed courses automatically; of keeping distances and times; of recognizing and warning in advance of dangerous impending situations; and of representing on a monitor the self-motion, in particular the speed, lap times, intermediate times, start to finish times and other relevant data. In additional, this embodiment is capable of displaying these acquired data in an optical or acoustic manner.

Figure 9:
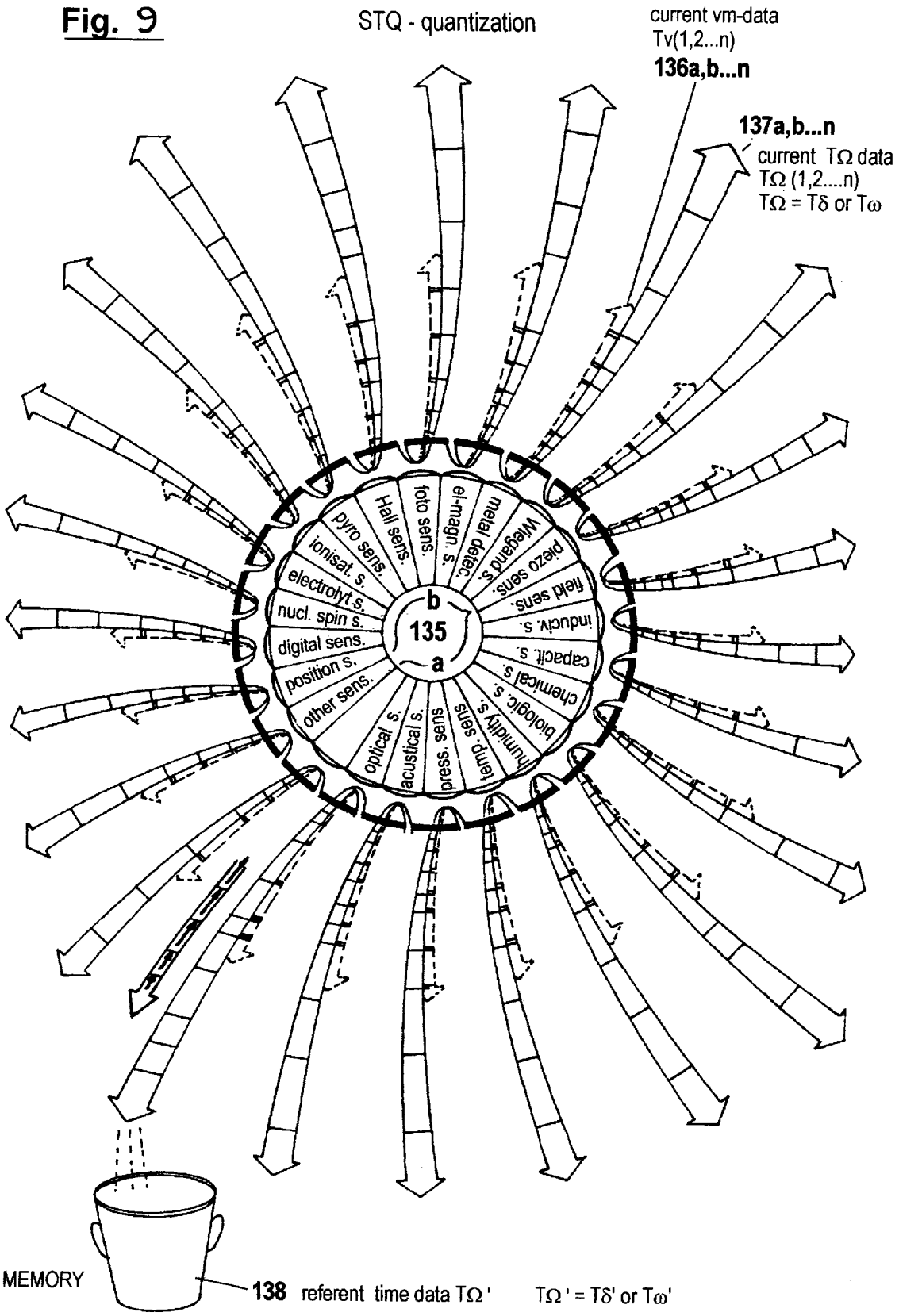

FIG. 9 shows a schematic diagram of the automatic focusing of certain perception zones or threshold values, through which it is intended to improve and optimize the recognition capability and the auto-covariant behaviour of the system in motion. (This point is object of an additional patent application).

DETAILED DESCRIPTION OF THE INVENTION

FIG. 1 shows a diagram of SHANNON's deterministic method of discrete time quantization of signal amplitude traces, which are digitized by analog/digital converters. In the usual technical language this method is called "sampling". This deterministic quantization method is characterized by quantized data (a1,a2,a3 . . . an) which correlate to certain points in time (T1,T2,T3, . . . Tn) that are predetermined from the program counter of a processor. In present day robotics practice, this currently used deterministic method requires very fast processors, high sampling rates and highly redundant calculations for the processing and evaluation of data. If one wants to acquire sensor data from signal amplitudes of external sources for the purpose of getting information about the spatial surroundings of a system in which a sensor coupled processor is installed, SHANNON's method is incapable of generating suitable data for the immediate relative speed and temporal allocation, data which are necessary to optimize the coordination of the relative self-motion. A recognition of its own motion in real time therefore is not possible. For this reason, this currently used deterministic method is inadequate for the generation of highly effective autonomous robot systems.

FIGS. 2*a–c* show three different graphs of direct "sensory quantization" of signal amplitude traces by means of the herein described invented method. In contrast to the quantization method shown in FIG. 1, in this method no vertical segments of amplitude traces are scanned; there are only elapse time measurements carried out in three different complementary ways. As is easy seen, it is necessary to predefine certain numbers of threshold values 1 (P1, P2, . . . Pn) in order to provide different sensory perception zones. Each residence time within a zone and time interval between zones is recorded, as well as the elapse time between the transition from a lower to a higher threshold value and vice versa.

FIG. 2*a* shows the first of these three types of sensory time quantization. It is designated STQ(v) elapse time (i.e. sensitivity/time quantum of velocity), and produces a parameter for the relative moment speed vm. It can also be understood as the time duration between the phase transitions of two parallel signal traces at the same threshold value potential. That is similar to the standard term "phase shift". In the graph, the measured STQ(v) elapse times are designated with Tv(n). The phase transitions at the amplitude trace V, which is produced when the sensor (or receptor) 2 passes along a corresponding external signal source 4, are designated iTv(n.n); the phase transitions at the amplitude trace W, which are produced when the sensor (or receptor) 3 passes along the same signal source, are designated with iTw(n,n). In the ideal case, the sensors 3, 4 are close together compared to the distance c between external signal source and sensors, c remains approximately constant, and both sensors (or receptors) display identical properties and provide an analogue signal; then two amplitude traces V and W are produced at the outputs of the mentioned sensors (the sensor amplifiers or receptors, respectively) which are approximately congruent. (Deviations from ideal conditions are compensated by an autonomous adaptation of the sensory system in a continuously improved way, which is described later). When sensor 2, in the designated direction, moves along the signal source 4, then the signal amplitude V passes through the predefined threshold potential P1 at phase transition iTv(1.1). The rising signal edge actuates a first timer that records the first STQ(v) elapse time Tv(1).

The continually rising signal amplitude V passes through the threshold potentials P2, P3 and P4; the phase transition of each of these activates further timers used for recording of further elapse times Tv(2), Tv(3) and Tv(4). Meanwhile, sensor 3 has approached signal source 4 and produces the signal amplitude trace W. When W passes through the threshold potential P1 at the phase transition iTw(1.1), the rising signal edge stops the timer, and the first STQ(v) elapse time is recorded and stored. The same procedure is repeated for the elapse times Tv(2), Tv(3) and Tv(4), when the signal amplitude passes through the next higher threshold values P2, P3 and P4. If V begins to fall, it first passes through the threshold value P4 on the falling shoulder of the amplitude trace. Now, the falling signal edge activates a timer that records the next elapse time Tv(5). At the further phase transitions iTv(3.2) and iTv(2.2), where the threshold values P3 and P2 are passed downwards, there are also timers which are actuated when the signal edges fall, in order to measure the elapse times Tv(6), Tv(7). If the signal amplitude V rises again, the STQ(v) parameters are recorded by the rising signal edges again. The same procedure is applied to stopping the timers at the phase transitions of the signal amplitude W. This produces the time displacement.

FIG. 2*b* shows another type of sensory STQ quantization. It is called STQ(i) elapse time (i.e., sensitivity/time quantum of interarrival). Simply, it is the time Tw a mobile system needs for a relative length. It can also be understood as the time duration between phase transitions of a signal trace at same threshold potentials. If the time counting frequencies corresponding to the relative speed parameters Tv, (i.e., the STQ(v) elapse times) are proportionally accelerated or decelerated, the recorded modulated time pulses correlate with the relative lengths. With absolute physical invariance between the sensor and the signal sources (i.e., synchronism), no STQ(v) parameter can be acquired, but if an equivalent signal intensity is changing, STQ(v) data are even obtainable when there is no relative motion. Therefore, during motion, these data are necessary not only for recording variable signals, but also for scanning spatial surroundings.

In this Figure, measured STQ(i) elapse times are designated with Tw(n). The phase transitions, which are produced by the amplitude trace W when the sensor (or receptor) 5 is moving along the corresponding adjacent signal sources 6 and 7, are designated with iTw(n.n). As soon as the sensor (or receptor) 5 passes in the marked direction along the signal source 6, the signal amplitude W goes through the pre-defined threshold potential P1 at phase transition iTw (1.1). The rising signal edge activates a first timer for the recording of the first STQ(i) elapse time Tw(1). Thereafter, the continually rising signal amplitude W passes through the pre-defined threshold potentials P2, P3 and P4, and when these show a phase transition, further timers are activated in order to record further elapse times Tw(2), Tw(3) and Tw(4). Meanwhile, sensor 5 begins to move away from the vicinity of the signal source 6. The falling amplitude trace passes through the threshold potential P4, and upon the phase transition iTw(4.2) the falling signal edge stops the timer that was recording the STQ(i) elapse time Tw(4). Simultaneously, the same falling signal edge activates another timer which measures the elapsed time Tw(5) up to the arrival of the next rising signal edge. But this signal edge rises when sensor 5 passes along the equivalent signal source 7. However, previously, the signal amplitude falls under the threshold values P3 and P2, and when these show the phase transitions iTw(3.2) and iTw(2.2), the timers recording the STQ(i) elapse times Tw(3) and Tw(2) are stopped. Simultaneously, additional timers recording the elapse times Tw(6) and Tw(7) are activated. They stop again at the phase transitions iT(2.3), iTw(3.3), iTw(4.3) and iTw(5.1), when the signal amplitude goes upwards again (but not before the sensor motion along signal source 7 starts). After those phase transitions, new timers start recording the next elapse times Tw(8), Tw(9), Tw(10), Tw(11), and so on.

FIG. 2*c* shows a third type of sensory STQ quantization that is completely different to those of FIGS. 2*a* and 2*b*. It is termed STQ(d) elapse time (i.e., sensitivity/time quantity of differentiation); and it can be understood as the time duration Td, measured between a first phase transition at a first predefined threshold potential up to the next phase transition at the next threshold potential, which can be either higher or lower than the first one. STQ(d) elapse times are parameters for the slope of signal amplitude traces, and consequently they are parameters for their frequency. By fast comparison of STQ(d) elapse times, signal courses can be recognized in real time; therefore, for the creation of intelligent behavior, STQ(d) quanta are just as imperative as STQ(v) quanta and STQ(i) quanta. The quantization of STQ(d) elapse times is possible under all variable physical states and arbitrary relative motion between sensor and external sources, in which STQ(v) and STQ(i) elapse times are also quantizable. If the STQ(d) elapse times are acquired cumulatively and serially, then they can be used in the verification and plausibility examination of STQ(i) elapse times (which are likewise acquired).

In the graph, the measured STQ(d) elapse times are designated with Td(n). The phase transitions which are produced by the amplitude trace W when the sensor (or receptor) 8 is in the field of a corresponding signal source 9, are designated with iTw(n.n). When sensor 8 moves along the corresponding signal-source 9 in the direction shown, at first the signal amplitude W passes through the pre-defined threshold value P1 at the phase transition iTw(1.1). Of course, this also happens when the field of this signal source is active and/or variable, although the sensor and the corresponding signal source are in an invariant opposite position. The rising signal edge activates a first timer that records the first STQ(d) elapse time Td(1). When the rising amplitude trace W passes through the next higher threshold value P2 at the phase transition iTw(2.1), this timer is stopped and the measured STQ(d) elapse time Td(1) is stored. Simultaneously, the next timer is activated, and records the elapse time up to the next phase transition at iTw(3.1), upon which it is stopped; then the next timer is activated up to the next transition iTw(4.1), upon which it is stopped again, and so on. (All the measured elapse times are stored in memory). At the phase transition iTw(4.1) the next timer is activated by threshold potential P4. However, since the amplitude trace does not reach the next higher threshold value before falling to P4 again, no STQ(d) can be acquired with the last timer. Thus in this position only the quantization of STQ(i) elapse times, as described in FIG. 2*b,* can take place. The next STQ(d) elapse time Td(4) can only be acquired when the signal amplitude falls below the threshold value P4 at the transition iTw(4.2), upon which the next timer is activated, and stopped when the phase transition at the next lower threshold value P3 occurs. Simultaneously, the next timer is activated, and so on.

In mechanistic applications, where the analysis of signal amplitudes requires the quantization of STQ(d) elapse times, STQ(d) data are often acquired in combination with STQ(i) data. If it is intended to use this quantization method to enable a robot to recognize its own motion from a subjective view (by detecting and scanning the spatial surroundings when one moves along external signal sources), then STQ (v) and STQ(i) data are predominantly acquired. However, if the main intention is to recognize external, non-static optical or acoustic sources such as objects, pictures, music or conversations etc., then the proportion of STQ(d) parameters increases, while the proportion of STQ(v) parameters decreases. In the case of physical invariance (i.e. when there is no relative motion) no speed parameters can be derived from any sensor signals, and only STQ(d) and STQ(i) elapse times are quantized.

FIGS. 3*a–c* illustrate an important aspect of the performance of the present method, in connection with serial transfer of acquired STQ(d) elapse times, as well as in connection with time pulse frequency modulation in relation to simultaneously acquired STQ(v) parameters which represent the instantaneous relative speed (vm). However, this instantiation of the method is only suitable where mainly STQ(d) elapse times are measured, together with those STQ(i) elapse times (see also FIG. 2*c*) which are produced at the phase transitions when maximal threshold value near the maximum of the amplitude are reached, or when the minimal threshold value near the minimum of the amplitude is reached. In this case, all measured elapse times can be represented as serial data sequences. But if each phase transition at each threshold potential generates STQ(d) elapse times as well as STQ(i) elapse times (see also the notes for FIG. 5), then these data are produced in parallel, and therefore they have to be processed in parallel.

FIG. 3*a* shows how a simple serial pulse sequence can be sufficient for data transport of acquired STQ(d) elapse times, if the threshold potentials P1, P2, P3 . . . that define the phase transitions 1.1, 2.1, 3.1 . . . from which the STQ elapse times are derived, are "marked" either by codes or by certain characteristic frequencies. In this figure, these "markers" are pulses with period t(P1), t(P2), t(P3) . . . and frequencies f(P1), f(P2), f(P3) . . . These are modulated according to the respective threshold potentials. These identification pulses (IP) serve to identify the pre-defined threshold values P1, P2, P3 . . . , (or the perception zones 1, 2, 3 . . . , respectively). Only these identification pulses, in cooperation with invariable time counting pulses (ITPC) with the period tscan, or in cooperation with variable (vm modulated) time counting pulses (VTCP) with the period t.vscan (see also FIGS. 3*b,* 3*c*), enable the actual acquisition of the STQ(d) elapse times Td(1), Td(2), Td(3), Td(4), . . . (or, respectively, the STQ(i) elapse times Tw(1), Tw(2), Tw(3), Tw(4), . . . that are produced at amplitude maxima or minima), as we have already described. Variable VTCP pulses with the period t.vscan, which are automatically modulated relative to the acquired STQ(v) parameters (i.e., the instantaneous moment speed vm), are used to scan the signal amplitudes that are derived from external sources, in a manner proportional to speed. This reduces the redundancy of the calculation processes considerably (see also FIG. 3*c*). The STQ(d) elapse times that are acquired in such a vm-adapted manner by VTCP pulses are designated with Tδ(1,2,3, . . . ); the STQ(i) elapse times, acquired in the same manner, are designated with Tω(1,2,3 . . . ).

FIG. 3*b* shows the measurement of STQ(d) elapse times with invariant ITPC pulses with period tscan and constant frequency fscan. This takes place as long as no STQ(v) parameter is acquired, e.g. when no relative motion is present between sensor and signal sources, and therefore when no relative speed (vm) can be measured.

FIG. 3*c* shows the measurement of STQ elapse times with modulated VTCP pulses. These time counting pulses depend on the instantaneous relative speed vm (or on the acquired STQ(v) parameter, respectively) as well as their period t.vscan and frequency *f*scan in a manner that is proportion to vm. If vm is very small or tends to zero, then the counting frequency *f*scan is likewise reduced to the minimum frequency fscan (as seen in FIG. 3*b*). As shown in FIG. 2*a,* each STQ(v) parameter is acquired by means of a second adequate "front" sensor (or receptor). Vm is thus already recorded even before the actual STQ(d) and/or STQ(i) elapse time measurement. Therefore it is possible automatically to modulate *f*scan for the measurement of Tδ(1,2, . . . n) time data according to the acquired STQ(v) parameters, in order to reduce the number of t.v calculations as well as to minimize memory requirements. Thus, a largely redundancy-free analysis results.

Although the time impulses counted with this method are approximately covariant with the relatively covered lengths (d), it can be proved that they nevertheless represent modified time data, and not distance data. As with the origin of those data, the further processing and analysis of such modified STQ elapse times Tδ(n) is dependent on probabilistic principles. The time data Tδ(n) are effectively "subjectively sensed".

In mechanistic systems the modulation of time counting frequencies in a manner proportional to distance traveled is done chiefly by means of programmable oscillators and timers, as illustrated in FIG. 5. However, in complex structured biological/chemical organisms, this self-adaptive process (a part of the so-called "autonomous adaptation") is generated mainly by proportional alteration of the propagation speed of timing pulses in neural fibers, as shown in FIGS. 4*a–d.* However, autonomous adaptation and self-adaptive time base-altering processes of the type described can also be formed differently. They can exist on molecular, atomic or subatomic length scales. The author names this principle "temporal auto-adaptation".

FIGS. 3*d–g* show the conceptual basis for the comparison of currently acquired STQ time data sequences with prior recorded STQ time data sequences, as well as their statistics-based analysis. The vm-modulated time data Tδ(n), shown in FIG. 3*d* having the sequence 32 30 22 23 20 (cs=cycles), are compared datum by datum with prior recorded time data Tδ(n)', having the sequence 30 29 22 24 19, which were likewise recorded in a vm-modulated manner. The comparison process is actually a covariance analysis. When the regression curves of both time data patterns converge, covariance exists. For these purposes, in mechanistic systems, coincidence measurement devices, comparator circuits, software for statistical analysis methods or "fuzzy logic" can be used.

The probability density parameters are added up, and as soon as the total value within a certain period exceeds a pre-defined threshold 10, then a signal 11 is produced that indicates that the sequence was "recognized". This signal predominantly serves to regulate adaptively the actuators in mechanistic systems (or motor behavior in organisms, respectively). Moreover, the signal shows that "autonomous adaptation" has taken place prior to these time data patterns being recorded. In respect of the motoric behavior of any mechanistic or biological organism, it is true that recognition of signal sequences goes hand in hand with automatic adaptation (or "autonomous adaptation", respectively). This principle is hereby termed "motoric auto-adaptation" or "auto-emulation".

FIG. 3*g* shows this auto-adaptation process in a schematic and easily comprehensible manner. A currently acquired Tδ time data sequence is continually compared with prior recorded Tδ' time data sequences, and if approximate covariance appears, then the sequences fit like a key into a lock. As described in the following sections, this process produces a type of "bootstrapping" or "motoric emulation", which constitutes a basic characteristic of redundancy-free autonomous self-organizing systems and organisms. Admittedly, the covariance analysis of two time data patterns in mechanistic/electronic systems is relatively complicated (see also FIG. 5). But this is not so in molecular/biological organisms and other systems. In such systems, this "bootstrapping" appears as a so-called "synergetic effect", which is approximately comparable with rolling a number of billiard balls into holes arranged in some pattern. (The name "synergetic" was first used by H. HAKEN in the year 1970.) Successful potting is determined by speed and direction. If the speed and direction are altered, no potting will take place. An attempt can also fail if the positions of the holes was somehow changed whilst the initial positions of the balls were kept constant, even if their speed and direction were covariant with the original speed and direction (and when the covariance does not adequately take into account the changing pattern).

In a similar way, a current STQ time data sequence, acquired by an autonomous self-organizing system, produces a characteristic fingerprint pattern, and whenever a previously recorded reference pattern is detected that is isomorphic to the currently recorded pattern, then auto-adaptation and auto-emulation results. This phenomenon is inherent in all life forms, organisms and elementary structures as a teleological principle. If no covariant reference pattern is found, the auto-adaptive regulating collapses and the system behaves chaotically. This motion changes from chaotic back to ordered as soon as currently recorded STQ time patterns begin to converge to prior recorded STQ time patterns that the analyzer finds to be covariant.

FIGS. 4*a–d* illustrate a model for the acquisition and processing of STQ(d) and STQ(v) elapse times (see also FIGS. 3*a–g*) and for temporal and motoric auto-adaptation in a molecular/biological context. The basic elements of the model have already been described in the neurophysiology literature by KATZ, GRAY, KELLY, REDMAN, J. ECCLES and others. The present invention is of special originality because temporal and motoric auto-adaptation is effected here by means of STQ quanta, which are described for the first time here. Such systems consist mainly of numerous neurons (nerve cells). The neurons are interconnected with receptors (sensory neurons), which enables the recording and recognition of the neurons' physical surroundings. In addition, the neurons cooperate with effectors (e.g. muscles) which serve as command executors for the motoric activity.

The expression "receptor" or "sensory neuron" corresponds to the mechanistic term "sensor". An "effector" is the same as an "actuator", which is a known term in the cybernetics literature. Each neuron consists of a cell membrane that encloses the cell contents and the cell nucleus. Varying numbers of branches from the neurons (axons, dendrites etc.) process information off to effectors or other neurons. The junction of a dendritic or axional ending with another cell is called a synapse. The neurons themselves can be understood as complex biomolecular sensors and time pulse generators; the synapses are time data analyzers which continually compare the currently recorded elapse time sequences with prior recorded elapse time patterns that were produced by the sensory neurons and were propagated along nerve fibers towards the synapses. In turn, a type of "covariance analysis" is carried out there, and adequate probability density signals are generated that propagate to other neighboring neural systems or to effectors.

FIG. 4*a* shows a so-called "action potential" AP that is produced at the cell membrane by an abrupt alteration of the distribution of sodium and potassium ions in the intra and extra-cellular solution, which works like a capacitor. These ionic concentrations keep a certain balance as long as no stimulus is produced by the receptor cell. In this equilibrium state, a constant negative potential 12, termed the "rest potential", exists at the cell membrane. As soon as a receptor perceives a stimulus from an external signal source, Na+ ions flow into the neutral cell, which causes the distribution of positive and negative ions to be suddenly inverted, and the cell membrane "depolarizes". Depending on the intensity of the receptor stimulus, several effects are produced:

(a) If the threshold P1 is not exceeded, then a so-called "electrotonic potential" EP is produced which propagates passively along the cell membrane (or axon fiber), and which decreases exponentially with respect to time and distance traveled. The production of EP is akin to igniting an empty fuse cord. The flame will stretch itself along the fuse, becoming weaker as it goes along, before finally going out. EP's originate with each stimulation of a neuron.

(b) If the threshold P1 is exceeded, then an "action potential" AP (as in FIG. 4*a*) is produced which propagates actively along the cell membrane (or axon fiber) with a constant amplitude in a self-regenerating manner. The production of AP is akin to a spark incident at a blasting fuse: the fiercely burning powder heats neighboring parts of the fuse, causing the powder there to burn, and so on, thus propagating the flame along the fuse.

AP's are used in the quantization of STQ(d) and STQ(v) elapse times. They are practically equivalent to identification pulses IP with periods t(P1), t(P2), t(Pn) . . . , which are shown in FIG. 3*a*. AP's signal the occurrence of the phase transitions from which STQ(d) and STQ(v) elapse times derive. In addition, the AP' indirectly activate the molecular/biological "timers" that are used for recording these elapse times. But AP's do not represent deterministic sampling rates for amplitude scanning; and they do not correspond to electronic voltage/frequency converters. Moreover, their amplitude is independent of the stimulation intensity at the receptor, and they do not represent the time counting pulses used in the measurement of elapse times. Rather, the recording of STQ elapse times is effected and modulated by the velocity with which the action potentials propagate along the nerve fibers (axons) and membrane regions.

The time measuring properties of AP's are described in detail in the following section:

If an EP, in answer to a receptor stimulus, exceeds a certain threshold value (P1) 13, then an AP is triggered. The amplitude trace of an AP begins with the upstroke 14 and ends with the repolarisation 15, or with the so-called "refiactory period", respectively. At the end of this process, the membrane potential decreases again to the resting potential P0, and the ionic distribution returns to equilibrium. Not each receptor stimulus generates sufficient electric conductivity to produce an AP. As long as it remains under a minimal threshold value P1, it generates only the electrotonic potential EP (introduced above). (For a better understanding of elapse time measurements in biological/chemical structures, see FIG. 2*c* and FIG. 3*a*). The first AP, which is triggered after a receptor is stimulated, generates initially (indirectly) the impulse that activates the first timer that records the first STQ(d) elapse time, when the signal amplitude W passes through the threshold value of the potential P1 at phase transition iTw(1.1). This signal represents simultaneously an identification pulse IP. The first AP corresponds to the first IP in a sequence of IP's that represents the respective threshold value status or perception zone in which the stimulation amplitudes were just found. As long as the stimulus at the receptor persists, an AP 16*a*, 16*b* . . . is triggered in temporal intervals whose duration depends on the respective thresholds in which the stimulus intensities have just been found.

These temporal intervals correspond to those IP periods t(P1), t(P2), . . . that are required for serial allocation and processing of STQ elapse times (see FIG. 3*a*). The AP frequency is stabilised through the so-called "relative refractory period" (i.e. downtime) after each AP, during which no new depolarisation is possible. Because the relative refractory period shortens itself adaptively in proportion to the increase in stimulation intensity at the receptor (e.g. if the EP reaches a higher threshold value P2 (or perception zone) 13*a*), there is a similarity here with "programmable bi-stable multivibrators" found in the usual mechanistic electronics. The downtime (refractory period) after an AP is shown as the divided line 19.

FIG. 4*a* illustrates an "absolute refractory period" t(tot) following a repolarisation. No new AP can be created during this time, irrespective of the stimulation intensity at the receptor rises. The maximum magnitude of a recognizable receptor stimulus is programmed in this way. Of importance is the fact that both the duration of the relative refractory period as well as character of the absolute refractory period are subordinate to auto-adaptive regularities, and are therefore continually adapting to newly appearing conditions in the organism. Consequently, the threshold values P0, P1, P2 . . . from which STQ quanta are derived are themselves not absolute values, but are subject to adaptive alteration like all other parameters; including, in particular, the physical "time".

We shall now elaborate upon what happens after the first STQ(d) elapse time at P1 is recorded via the first AP: If the stimulation intensity (with a theoretical amplitude W) increases from the lower threshold P1 to the next higher threshold P2, then the following AP triggers indirectly the recording of the second STQ(d) elapse time as soon as a phase transition occurs through the next higher threshold P2. The same process is repeated in turn for the threshold values P3, P4, . . . and so on. In each case, the AP functions simultaneously as an identification pulse IP, as described in FIG. 3*a*. It therefore recurs in threshold-dependent periods as long as a perception acts upon the receptor (i.e. for as long as the receptor is perceiving something).

As an example, consider also FIG. 3*a:* As long as the stimulation intensity remains in the zone P2, the AP 17, 17*a*,

17*b* . . . recurs in short temporal periods. These periods (or intervals) are similar to those periods of IP identification pulses (with period t(P2)) that are required for serial recording of the STQ elapse times Td(2) and Tw(2). When the increasing stimulation intensity reaches the threshold value P3 (or perception zone 3) 13*b,* the AP's recur in even shorter time periods 18*a,* 18*b,* 18*c* . . . This corresponds to the IP identification pulses with the period t(P3), shown in the figure, which are indirectly required for serial timing of the STQ elapse times Td(3) and Tw(3). An even larger stimulation intensity, for example in P4 (perception zone 4), would generate an even shorter period for the AP's. This would correspond approximately to t(P4) in FIG. 3*a.* The maximum possible AP pulse frequency is determined by t(tot). Shorter refractory periods, after the depolarization of APs, also produce smaller AP amplitudes. This property simplifies the allocation of AP's in addition.

In the following, the generation of the actual time counting pulses for STQ quantization is detailed. These pulses are either invariable ITPC or vm-proportional VTCP, as illustrated in FIG. 3*a.* The time counting pulses for the quantization of elapse times are dependent on the velocity with which the AP propagate along an axon. This velocity is in turn dependent on the "rest potential" and on the concentration of Na+ flowing into the intracellular space at the start of the depolarization process, as soon as perception at the receptor cell causes an electric current to influence the extra/intra-cellular ionic equilibrium.

With the commencement of stimulation of a receptor (at the outset of a perception), only capacitive current flows from the extra-cellular space into the intracellular fluid. This generates an "electrotonic potential" EP, which propagates passively. If this EP exceeds the threshold P1, then an AP, which propagates in a self-regenerating manner along the membrane districts, is produced. The greater the capacitive current still available after depolarisation (or "charge reversal") of the membrane capacitor, the greater the Na+ ion flow into the intracellular space, and the greater the available EP current that can flow into still undepolarized areas. The rate of further depolarization processes in the neuronal fibres, and consequently the propagation speeds of further AP's, are thus increased proportionally.

The charge reversal time of the membrane capacitor is therefore the parameter that determines the value 12 of the resting potential P0. When a stimulus ("excitation") starts from the lowest resting potential 12, then the Na+ influx is the largest, the EP-rise is steepest and the electrotonic flux is maximum. If an AP is triggered, then its propagation speed is in this case also maximum. But when a receptor stimulus starts from a higher potential 12*a,* 12*b,* 12*c* . . . , then the Na+ influx is partially inactivated, and the steepness of the EP-rise as well as its electrotonic flux velocity is decreased. Therefore, the propagation speed of an AP decreases too. These specific properties are used in molecular/biologic organisms to produce either invariant time counting impulses ITCP, with periods tscan, or variable time counting impulses VTCP, with periods t.vscan. In the latter case, the VTCP's are modulated in accordance with the relative speeds vm (via the STQ(v) parameters), and therefore have shorter intervals (see FIGS. 3*b,* 3*c*). The STQ(v) quantum is determined by the deviation of the respective starting-potential from the lowest resting-potential P0, which serves as a reference value, and is measured by the duration of the capacitive charging of a cell membrane when a stimulus occurs at the receptor.

The duration of the charging is inversely proportional to the velocity of the Na+ influx through the membrane channels into the intracellular space. A cell membrane can be understood as an electric capacitor, in which two conducting media, the intracellular and the extracellular solution, are separated from one another by the non-conducting layer, the membrane. The two media contain different distributions of Na/K/Cl ions. The greater the "stimulation dynamics" (see below) that first influences the outer molecular media—corresponding to sensor 2 in FIG. 2*a*—and, subsequently, the inner molecular media—which corresponds to sensor 1 in FIG. 2*a*—the faster is the Na+ influx and the shorter the charging time (which determines the parameter for the relative speed vm), and the faster is the AP propagation velocity v(ap) in the neighbouring membrane districts. The signals at the inner and outer sides, respectively, of the membrane, correspond to the signal amplitudes V and W. The velocity v(ap), therefore, indirectly generates the invariant time counting pulses ITCP or the variable vm-proportional time counting pulses VTCP.

These variable VTCP pulses are self-adaptive modulated time pulses that are correlated to the relative length. As explained in the following (contrary to the traditional physical sense), no "invariant time" exists—only "perceived time" exists. Of essential importance also is the difference between "stimulation intensity" whose measurement is determined by the AP frequency and therefore by the refractory period, and the "stimulation dynamics", whose measurement is defined by the charge duration of the cell membrane and therefore also by the speed of the Na+ influx. "Stimulation dynamics" is not the same as "increase of the stimulation intensity". It is a measure of the temporal/spatial variation of the position of the receptor relative to the position of the stimulus source, and therefore of the relative speed vm. The stimulation intensity corresponds to signal amplitudes, from which vm-adaptive STQ(d) elapse times Tδ(1,2,3 . . .) are derived, while the stimulation dynamics is defined by the acquired STQ(v) parameters.

FIG. 4*b* and FIG. 4*c* show the analysis of STQ elapse times in a molecular/biological model in an easily comprehensible manner. The results of the analysis are used to generate redundancy-free auto-adaptive pattern recognition as well as autonomous regulating and self-organization processes. The organism in the particular example shown here is forced to distinguish certain types of foreign bodies that press on its "skin". It must reply with a fast muscle reflex when it recognizes a pinprick. But it should ignore the stimulus when it recognizes a blunt object. A continuous vm-adaptive recording of STQ(d) elapse times by means of VTCP pulses is necessary to do this. The frequency of these time counting impulses is modulated in accordance with the STQ(v) parameters of the stimulus dynamics (vm). These STQ(v) parameters are required for the recording of the STQ(d) elapse times Tδ(1,2,3 . . . ) from the signal amplitude at the current stimulus intensity. The difference between "stimulation intensity" and "stimulation dynamics" is easily seen in this example. A stimulus can even show a different intensity if no temporal-spatial change takes place between signal source and receptor. A needle in the skin can cause a different sensory pattern even when its position is not changing if, for example, it is heated. This sensory pattern is determined by the signal amplitude, and consequently by the AP frequency and by the STQ(d) quanta. As long as the needle persists in an invariant position, the AP propagation velocity is constant, because the membrane charging time is constant too. During the prick into the skin, there is a "dynamic stimulation", and the STQ(d) quantization of the signal amplitude is carried out in a manner that depends on the pricking speed vm. It should be noted that two temporally displaced signal amplitudes (at the inner and outer membrane surface) always exist during this dynamic process. The STQ(v) parameters are derived from this. The AP propagation velocities and the acquired STQ(d) time patterns are adapted accordingly ("temporal auto-adaptation").

The STQ(d) time patterns Tδ(1,2,3,4 . . . ), measured adaptively according to the vm, are constantly compared to and analysed together with the previously measured and stored STQ(d) time patterns Tδ'(1,2,3 . . . ). This time comparation process occurs continuously in the so-called synapses, which are the junctions to axional endings of other neurons. The probability density values that are produced at the synapses, and which are used to represent the convergence of both regression curves, are communicated for further processing to peripheral neural systems, or to muscle fibres in order to trigger motoric reflex.

FIG. 4*b* shows the vm-dependent propagation of an AP from a sensory neuron (receptor) 20 along an axon to a synapsis, where a comparison of acquired time sequences takes place through molecular "covariance analysis". This receptor functions like a "pressure sensor". If a needle 21 with a certain dynamics impinges on the outer side of the cell membrane, then this stimulation causes triggering of AP's 23 as described in FIG. 4*a*. The AP's propagate in the axon 22 with a STQ(v)-dependent speed vap. The sequence (a' . . . v') represents the signal amplitude values that are produced by the pinprick. The sequence begins with the phase transition at the first threshold value P1, continues over P2, P3, P4 (at which point the stimulus maximum is attained), and finally to the phase transitions through P3 and P2. The intensity zones for stimulus perception are designated with Z1, Z2, Z3 and Z4. The periods t(P1), t(P2), t(P3), t(P4) . . . , and the magnitudes of the AP's serve to identify the particular threshold in which the stimulation intensity is currently to be found. Their temporal sequence is therefore a type of "code". AP's are not time counting pulses. Besides their coding function, they also serve as (indirect) activating and deactivating pulses for the recording of STQ(d) elapse times. The actual vm-dependent measurement of the STQ elapse times Td(1), Td(2), Td(3), Tw(4) and Td(4) . . . (see FIG. 2*c*), as well as the comparison of these with previously recorded elapse times, takes place in the synapse 24.

At the presynaptic terminal of the axons, the AP's 23 arrive with variable velocities vm(n . . . ), according to the dynamics of the needle prick as well as the measured STQ(v) parameters. This variable arrival velocity at the synapses is the key to producing the adaptive time counting impulses VTCP (see FIG. 3*c*) with vm-modulated frequency ƒscan. The synapse is separated from the postsynaptic membrane by the "synaptic cleft", and the postsynaptic membrane, for its part, is interconnected with other neurons; for instance, to a "motorneuron" 25. This neuron generates a so-called "excitatory postsynaptic potential" (ESPS) 27 that is approximately proportional to the convergence probability g. If this EPSP (or, equivalently, the probability density g) exceeds a certain threshold value, then, in turn, an action potential AP 28 is triggered. This AP is communicated via motoaxon 26 to the "neuromuscular junction", at which a muscle reflex is triggered. The incoming AP sequences 23 generate the release of particular amounts of molecular transmitter substance from their repositories—tiny spherical structures in the synapse, termed "vesicles". In principle, a synapse is a complex programmable timedata processor and analyzer that empties the contents of a vesicle into the presynaptic cleft when the recurrence of any prior recorded synaptic structure is confirmed within a newly recorded key sequence. The synaptic structures and vesicle motions are generated by the dynamics (vap) of the AP ionic flux, as well as by its frequency. AP influx velocities v(ap) correspond to the STQ(v) elapse times, and AP frequencies correspond to the STQ(d) elapse times. The transmitter substance is reabsorbed by the synapse, and reused later, whereby the cycle continues uninterrupted.

We now present a detailed description of FIG. 4*b* (referring also to FIGS. 4*e* and 4*f*). The ionic influx of the initial incoming AP 23 (a') activates the spherical structures (vesicles) containing the ACh transmitter molecules. These molecules are released in the form of a "packet". The duration of this ACh packaging depends on the dynamics (represented by the velocity v(ap)) of the AP ionic influx at the presynaptic terminal, and therefore on the stimulus dynamics (represented by vm) at the receptor 20. Each subsequent incoming AP, namely b', c' . . . , in turn causes neurotransmitter substances in the vesicle to be released toward the synaptic cleft. Each of the following are elapse time counting and covariance analyzing characteristics: the duration of accumulation of neurotransmitter substance T(t); the velocities v(t) with which the neurotransmitter substances move in the direction of the synaptic cleft; the effects induced by the neurotransmitter substances at the synaptic lattice at the synaptic cleft; the duration of pore opening; and so on. By means of AP's acting on synaptic structures, not only are the actual time counting frequencies ƒscan generated (to be used in vm-dependent measurement of STQ(d) elapse times as described in FIG. 2*c*), but also time patterns are stored and analysed.

If the pattern of a current temporal sequence is recognised by the synapse as matching an existing stored pattern, a pore opens at the synaptic lattice, and all of the neurotransmitter content of a vesicle is released into the subsynaptic cleft. The released transmitter molecules (mostly ACh) combine at the other side of the cleft with specific receptor molecules of the sub-synaptic membrane of the coupled neuron. Thus, a postsynaptic potential (EPSP) is generated, which then propagates to other synapses, dendrites, or to a "neuromuscular junction". If the EPSP exceeds a certain amplitude, then it triggers an action potential (AP) of the described type, which then triggers, for example, a muscle reflex. If the potential does not reach this threshold, then the EPSP propagates in the same manner as an EP (i.e. in an electrotonic manner); an AP is not produced in this case.

Of special significance is the summing property of the subsynaptic membrane. This characteristic, termed "temporal facility", results in the summation of amplitudes of the generated EPSP's, if they arrive in short sequences within certain time intervals. Each release of neurotransmitter molecules into the synaptic cleft designates an increased probability density occurring during the comparison of instantaneous vm-proportionally acquired STQ time patterns to prior vm-proportionally recorded STQ time patterns. Increased probability density causes a higher frequency of transmitter substance release and therefore a higher summation rate of the EPSP's, which in turn produces, at a significantly increased rate, postsynaptic action potentials (AP). Therefore, a postsynaptic AP is effectively a confirmation signal that flags the fact that isomorphism between a previously and currently recorded time data pattern has been recognized. On the basis of this time pattern comparison, the object that caused the perception at the receptor cell is thereby identified as "needle"; and the command to "trigger a muscle reflex" is conveyed to the corresponding muscle fibres.

Parallel and more exact recognition processes are executed by the central nervous system CNS (i.e. the brain).

From the sensitive skin-receptor neuron 20, a further axonal branching 29 is connected via a synapse 30 to a "CNS neuron". In contrast to the "motorneuron" which actuates the motoric activity of the organism directly, a CNS neuron serves for the conscious recognition of a receptoric stimulation sequence. An AP 31, produced at the postsynaptic cell membrane 30, can spread out along dendrites in the axon 30*a,* as well as to several other CNS neurons; or, alternatively, indirectly via CNS neurons to a motorneuron, then on to a neuromuscular junction.

The parameters controlling the recording of STQ time quanta in the synapses 25 and 30 can differ with different synaptic structures. (Indeed, the synaptic structures themselves are generated by continuous "learning" processes). This explains how it is possible for a needle prick to be registered by the brain, while eliciting no muscular response; or how a fast muscle reflex can be produced while a cause is hardly perceived by the brain. The first case shows a conscious reflex, the other case an instinctive reflex. The former occurs when the CNS synapse 30 cannot find enough isomorphic structures (in contrast to the synapse 25), transmitter molecules are not released with sufficient frequency, and subsequently no postsynaptic AP 31 and no conscious recognition of the perceived stimulus can take place. Numerous functions of the central nervous system can be explained in such a monistic way; as well as phenomena such as "consciousness" and "subconscious". Generally, auto-adaptive processes are deeply interlaced in organisms, and are therefore extremely complex. In order to be capable of distinguishing a needle prick from the pressure of a blunt eraser, essentially more time patterns are necessary; in addition, more receptors and synapses must be involved in the recognition process.

FIG. 4*c* illustrates the process by which moderate pressure from a blunt object (e.g. a conical eraser on a pin) is recognized, resulting in no muscle reflex. The blunt object 32 presses down with a certain relative velocity vm onto a series of receptors in neural skin cells 33, 34, 35, 36 and 37. Several sequences of AP's 39, 40, 41, 42 and 43 are produced after the individual adjacent receptors (see also FIG. 4*b*) are stimulated. These action potentials propagate along the collateral axons 38 with variable periods t(P1,2,3 . . . ) and velocities vap(1 . . . 5), which result on the one hand from the prevailing stimulation intensity, and on the other hand from the respective stimulation dynamics. Since each receptor stimulus generates a different pattern of STQ(v) and STQ(d) quanta, various AP sequences a' . . . m' emerge from each axon. All sequences taken together represent the pattern of STQ elapse times which characterises the pressure of the eraser on the skin. These variable AP ionic fluxes reach the synapses 44, 45, 46, 47 and 48, which are interconnected via the synaptic cleft with the motoneuron 49. As soon as the currently acquired STQ time data pattern shows a similarity to a prior recorded STQ time data pattern, each individual synapse releases the contents of a vesicle into the subsynaptic cleft. Simultaneously, this produces an EPSP at the subsynaptic membrane of the neuron. These EPSP potentials are mostly below the threshold. The required threshold value for the release of an AP is reached only when a number of EPSP's are summed. This happens only when a so-called "temporal facilitation" of such potentials occurs, as described in the previous paragraph.

In the model shown, the individual EPSP's 50, 51, 52, 53 and 54 effect this summing property of the subsynaptic membrane. These potentials correspond to receptor-specific probability density parameters g1, g2, g3, g4 and g5, that represent the degree of isomorphity of time patterns. Simultaneous neurotransmitter release in several synapses, for example in 45 and 47, causes particular EPSP's to be summed to a total potential 56, which represents the sum of the particular probability densities G=g1+g3. This property of the neurons (i.e. the summing of spatially separated subliminal EPSP's when release of neurotransmitter substance appears simultaneously at a number of parallel synapses on the same subsynaptic membrane) is termed "spatial facilitation".

In the described model case, the summed EPSP 56 does not, however, reach the marked threshold (gt), and therefore no AP is produced. Instead, the EPSP propagates in the sub-synaptic membrane region 49 of the neuron, or in the following motoaxon 55, respectively, as a passive electrotonic potential (EP). Such an EP attenuates (in contrast to a self-generating active AP) a few millimeters along the axon, and therefore has no activating influence on the neuromuscular junction, and consequently no activating influence on the muscle. The stimulation of the skin by pressing with the eraser is therefore not sufficient to evoke a muscle reflex.

It would be a different occurance if the eraser would break off and the empty pin meet the skin receptors with full force. In this case, neurotransmitter substances would be released simultaneously in all five synapses 50, 51, 52, 53 and 54, because the acquired STQ time patterns Tδ(1,2,3 . . . ), with very high probability, would be similar to those STQ time patterns Tδ'(1,2,3 . . . ) already stored in the synaptic structures that pertain to the event "needle prick". The EPSP's would be summed, because of their temporal and spatial "facilitation", to a supraliminal EPSP 56, and a postsynaptic AP would be produced that propagates along the motoaxon 55 in a self-regenerating manner (without temporal and spatial attenuation) up to the muscle, producing a muscle reflex.

As in FIG. 4*b,* in the present example a recognition process takes place in the central nervous system (CNS) that proceeds in parallel. From the skin receptor cells 33, 34, 35, 36 and 37, collateral axonal branches extend to CNS synapses that are connected to other neurons 58. Such branches are termed "divergences". The subdivision of axons into collateral branches in different neural CNS districts, and the temporal and spatial combination of many postsynaptic EPSP's, allows conscious recognition of complex perceptions in the brain (for example, the fact of an eraser pressing onto the skin). Since this recognition has to take place independent of the production of a muscle reflex, the sum of individual EPSP's must be supraliminal in the CNS. Otherwise, no postsynaptic AP—i.e. no signal of confirmation—can be produced.

As an essential prerequisite for this, it is necessary that auto-adaptive processes have already occurred which have formed certain pre-synaptic and sub-synaptic STQ time structures in the parallel synapses 58. These structures hold information (time sequences; i.e. patterns) pertaining to similar sensory experiences (e.g. "objects impinging on the skin"—amongst these, a conical eraser). Obviously the threshold for causing an AP in the postsynaptic membrane structure of the ZNS Neurons 58 (and therefore also in the brain) has to be lower than in the motoneuron membrane 49 described previously. Therefore also the sum of these EPSP's must be larger than the sum of the EPSP's g1, g2, g3, g4 and g5. Isomorphisms of STQ time patterns in the CNS synapses of the brain have to be more precisely marked out than those in the synapses of motoneurons, which are only responsible for muscle reflexes. The structure of the CNS synapses must be able to discern finer information, so it must be more subtle. The production of a sub-synaptic AP represents a confirmation of the fact that a currently acquired Tδ(1,2,3 . . . ) time pattern is virtually isomorphic to a prior recorded reference time pattern Tδ'(1,2,3 . . . ), which, for example, arose from a former sensory experience with an eraser impinging at a certain location on the skin. If such a former experience has not taken place, the consciousness has no physical basis for the recognition, since the basis for time pattern comparison is missing. In such a case, therefore, a learning process would first have to occur. Most of the time, however, sensory experiences of a visual, acoustic or other type, arising from a variety of receptor stimulation events, are co-ordinated with the pressure sensing experience.

This explains why CNS structures are extremely intensively interlaced. CNS neurons, as well as motoneurons, have up to 5000 coupled synapses, which are interconnected in a multifarious manner with receptor neurons and axonal branches. There are complex time data patterns for lower and higher task sites, which are structured in a hierarchical manner. We have already described simple Tδ(1,2,3 . . . ) and Tδ'(1,2,3 . . .) analysis operations. Blood circulation, respiration, co-ordination of muscle systems, growth, seeing, hearing, speaking, smelling, and so on, necessitate an extremely large number of synaptic recorded "landscapes" of the organism's STQ time patterns, produced by a variety of receptors; and which continually have to be analysed for isomorphism with time patterns currently being recorded. Accordingly, temporal and motoric auto-adaptation occurs in deeper and higher hierarchies and at various levels.

FIG. 4*d* illustrate the counterpart to the EPSP (Excitatory Postsynaptic Potential): the "Inhibitory Postsynaptic Potential ", or IPSP. As seen in the figure, the IPSP potentials 61, 62, 63, 64 and 65 at the subsynaptic membrane 60 are negative compared to the corresponding EPSP's. IPSP's are produced by a considerable proportion of the synapses to effect pre-synaptic inhibition instead of activation. The example here shows an IPSP packet 67 propagating from the motoaxon 66 to a neuromuscular junction (or muscle fibre, respectively) which prevents this muscle from being activated—even if a supraliminal EPSP were to reach the same muscle fibre at the same time via a parallel motoaxon.

Positive EPSP's ion fluxes and negative IPSP's ion fluxes counterbalance each other. The main function of the IPSP's is to enable co-ordinated and homogeneous changes of state in the organism, e.g. to enable exact timing of motion sequences. In order to ensure, for example, a constant arm swing, it is necessary to activate the bicep muscles, which then flex the elbow with the aid of EPSP's; but to inhibit the antagonistic tricep muscles (which extend the elbow) with the aid of IPSP's. Antagonist muscles must be inhibited via so-called "antagonistic motoneurons", while the other muscle is activated via "homonym motoneurons". The complex synergism of excitatory (EPSP) synapses and inhibitory (IPSP) synapses act like a feedback system (servoloop) and enables optimal timing and efficiency in the organism. One can compare this process with a servo-drive, or with power-steering, which ensures correct co-ordination and execution of current motion through data-supported operations and controls. If data are missing, the servoloop collapses. Disturbances in a molecular biological servoloop that is supported by STQ time data structures lead to tetanic twitches, arbitrary contractions, chaotic cramps and so on.

From the point of view of cybernetics, each excitatory synapse generates a "motoric impulse" (EPSP), while each inhibitory synapse generates a "brake impulse" (LPSP). The continued tuning of the complicated servoloops, and the balance which results from continuous comparison of prior sensory experiences (the stored reference time patterns) with current sensory experiences (the time patterns currently being recorded), creates "perfect timing" in the organism.

FIG. 4*e* shows the basic construction of a synapse. Axon 68 ends at the pre-synaptic terminal 69, which is also termed "bouton". The serial incoming AP's cause the vesicles to be filled with neurotransmitter molecules. When the filling process is finished, the vesicles begin to move in the direction of the pre-synaptic lattice 71. If a currently acquired time pattern is approximately isomorphic to an existing time pattern (see also FIG. 4*b*), then a small canal opens at an attachment site on the lattice, which releases the entire contents of the vesicle into the narrow synaptic cleft 72. This process is termed "exocytosis". The sub-synaptic neural membrane 73 supports specific molecular receptors 73*a,* to which the released transmitter molecules bind themselves.

For a certain period, a pore opens, through which the transmitter substance diffuses. The conductivity of the postsynaptic membrane increases and the EPSP (following postsynaptic depolarisation) is triggered. The duration of opening of the pores and the recognition of complementary receptors by the molecules are likewise determined by auto-adaptive processes and evaluation of STQ time pattern structures. However, these molecular processes represent deeper sub-phenomena in comparison to synaptic processes. Structures for temporal and motoric auto-adaptation, which depend on quantization of STQ elapse times, also exist at the molecular and atomic levels.

FIG. 4*f* shows the filling of a vesicle 70 with neurotransmitting substances, and its subsequent motion towards a pre-synaptic dense projection at the lattice 71. The start of the filling process 74 can be seen as the activation of a stopwatch. The rate v(t) of the filling is proportional to the dynamics of the AP ionic flux into the synapse. The periods T(t . . . ) of the filling follow the periods t(P1,P2, . . . ) of the arriving AP's; these times, therefore, represent vm-adaptive quantized STQ(d) elapse times Tδ(1,2,3 . . . ). The direction of filling is shown at 75. The direction of motion of a vesicle is shown at 75. If the current velocity v(t), the duration of the vesicle packaging T(t), the quantity of transmitter molecules, the current vesicle motion and other currently significant STQ parameters have characteristics which correlate to an existing synaptic STQ structure, then a filled vesicle binds itself onto an "attachment site" 77 at the lattice. Ca++ ions flow into the synapse, a pore at the paracrystalline vesicle lattice opens, and the entire molecular neurotransmitter content is released into the synaptic cleft 72. At the postsynaptic membrane of the target neuron, these molecules are fused with specific receptor molecules. Such receptors have verification tasks. They prevent foreign transmitter substances (that originate from other synapses) from producing wrong ESPS's at this neuron.

To complete the discussion of FIG. 4, we relate the descriptions of FIGS. 4*a,* 4*b,* 4*e* and 4*f* to the STQ configurations of FIGS. 3*a–g*. For argument's sake, we assume once again that a pinprick impinges onto a receptor cell (see also FIG. 4*b*).

The IP sequences shown in FIG. 3*a* correspond to the AP's 23 which are produced by stimulating a receptor cell 20 with a needle 21. Their periods t(P1), t(P2), . . . serve to classify the respective zones of stimulation intensity (P1, P2 . . . ) or perception intensity (Z1, Z2 . . . ). Each AP 23, arriving into a synapse 69, activates the adaptive quantization of STQ(d) elapse times, depending on the velocity vap of the propagation of the AP along the axon. Elapse timing with modulated time base is triggered as soon as a vesicle begins to fill. Finished filling (packaging) signifies "elapse timing stop, STQ(d)-quantum recorded". The elapse times Tδ(1), Tδ(2), Tδ(3), Tδ(4) . . . thus recorded generate the significant synaptic structures. Invariant time counting pulses ITCP (see FIG. 3*b*) with frequency fscan correspond to constant axonal AP propagation with velocity vap, if no dynamic stimulus appears at the skin receptor cell (for example, if a needle remains in a fixed position and generates a constant stimulation intensity). In this case, the receptor membrane senses no relative speed vm; the AP's propagate with constant velocity vap along the axon 22; and the synapse quantizes the STQ(d) elapse times with invariant time counting frequency fscan.

Time counting pulses VTCP (see FIG. 3*c*) with variable frequency *f*scan are then applied, if dynamic stimulation affects the receptor. The AP's propagate along the axon with STQ(v)-dependent velocities vap(n . . . ), modulated by the variable dynamics vm(n . . . ) which are measured as an STQ(v) parameter by the membrane. Adaptive alteration of all of the following processes occurs in a similar manner: the variation of time counting periods t(P1 . . . n) corresponding to the points 2.1, 3.1, 4.1 in FIG. 3*c;* the velocities v(t . . . ) of AP ionic flux into the synapse; the vesicle filling times T(t . . . ); the amounts of transmitter molecules contained in the vesicles; the motion of these molecules in the direction of the vesicle lattice; the structure of this lattice; and many other parameters of the presynaptic and subsynaptic structures.

A synapse has features that enable the conversion of the AP influx dynamics into vap-proportional molecular changes of states. This is like the variable VTCP time counting pulses seen in FIG. 3*c*. The process can be compared with variable water pressure driving a turbine, through which a generator produces variable frequencies depending on pressure and water speed: higher water pressure is akin to higher stimulation dynamics vm at the receptor, higher AP propagation velocity vap along the axon, and higher VTCP time pulse frequency *f*scan in the synapse (which in turn affects not only the rate v(t) with which vesicles are filled, but also many other synaptic parameters). According to these processes, the STQ(d) time sequence Tδ(1,2,3,4 . . . ) is recorded in the synapse with vm-modulated time counting frequencies *f*scan(1,2,3 . . . ); as a consequence, the physical structure of the synapse is determined by this time sequence.

FIG. 3*d* shows a currently acquired time data sequence 32 30 22 23 20 that is equivalent to the recorded time pattern Tδ(1,2,3 . . . ), and which leaves a specific molecular biological track in the synapse 24. The prior acquired time data sequence 30 29 22 24 19 in FIG. 3*e* corresponds to the synaptic structure that has been "engraved" through frequent repetition of particular stimulation events and time patterns Tδ (1,2,3 . . . ).

The manifested synaptic Tδ' structure can be considered also as a bootstrap sequence that was generated by continuous learning processes and perception experiences, and which, for example, serves as a reference pattern for the event "pinprick". If a newly acquired Tδ bootstrap sequence—which is given by the current properties of the vesicle filling, as well as other significant time dependent parameters—approximately keeps step with is existing Tδ' bootstrap sequence (or with a part of it), then "covariance" is acknowledged in the synaptic structure. This opens a vesicle attachment site at the synaptic lattice and results in the release of all transmitter molecules that are contained in a vesicle, whereupon an EPSP is generated at the subsynaptic membrane 25. The potential of an EPSP corresponds to the probability density parameters shown in FIG. 3*f,* which are significant for the currently evaluated covariance. If such "probability density parameters" sum within a certain time interval to a certain threshold potential 27, an AP 26 is produced. This AP serves as confirmation of the event "pin recognized", and produces a muscle reflex.

The comparison of the current elapse time pattern with prior recorded elapse time patterns, as shown in FIG. 3*c,* takes place continuously in the synapses. Each recognized covariance of a new time sequence, that is recorded by "temporal auto-adaptation", sets a type of "servoloop mechanism" in motion. It initiates a process that we term "motoric auto-adaptation", and which can be understood as the actual "motor" in biological chemical organisms, or life forms, respectively. Structures of temporal and motoric auto-adaptation, which are based on STQ quantization, exist also at the lowest molecular level. Without elapse time-supported servoloops, co-ordinated change in biological systems would be impossible. This applies especially to the motion of proteins; to the recognition and replication of the genetic code; and to other basic life processes. The creation of higher biological/chemical order and complex systems such as synapses or neurons presupposes the existence of an STQ quantization molecular sub-structure, from which simple acknowledgement and self-organization processes at a lower level derive. Indeed, there are innumerable hierarchies of auto-adaptive phenomena on various levels. Simple phenomena on a molecular level also include: fusion of receptor molecules; the formation of pores, ion canals and sub-axonal transportation structures (microtubules); and the formation of new synapses and axonal branchings.

By this token, recognition of stimulation signal sequences by synaptic time pattern comparison (as an involuntary reflex or as a conscious perception), as discussed in the description of FIGS. 4*a–c,* is an STQ-epiphenomenon. Each such auto-adaptive STQ-epiphenomenon, for its part, is superimposed from STQ-epiphenomena of higher rankings; for example, the analysis of complex "time landscapes" in order to find isomorphism. STQ-epiphenoma such as regulation of blood circulation, body temperature, respiration, the metabolism, seeing, hearing, speaking, smell, the co-ordination of motion, and so on, are for their parts superimposed from STQ-scenarios of higher complexity, including consciousness, thought, free will, conscious action, as well as an organism's sensation of time. In all these cases, the central nervous system looks after convergent time patterns that are placed like pieces of a jigsaw puzzle into an integrated total sensory scenario.

If, in any hierarchy, within a certain "latency time" (i.e. time limit) and despite intensive "searching", no time subpattern covariant with the STQ time pattern can be found, then the organism displays chaotic behaviour. This behaviour restricts itself to that synaptic part in which the non-convergence has appeared. As soon as a covariant time pattern is found, the co-ordinated process of temporal and motoric auto-adaptation (and auto-emulation) resumes. (This can be likened to servo-steering that has collapsed for a short time.) However, the "chaotic behaviour" is itself quantized as an STQ time pattern, and is recorded by the affected synapses in such a manner that no neurotransmitter substance release occurs despite arriving AP's. Via subaxonal transportation structures (i.e. the microtubules) such information streams back borne on transmitter molecules which travel in the inverse direction along the axon. Microtubules are used to generate new synapses and synaptic connections at the neurons and neural networks in which a collapse of an auto-adaptation process has occurred. The production of new synapses proceeds to the generation of dendrites; i.e., axonal branches that carry processing information from neurons. In this way the auto-adaptive neural feedback mechanism regenerates itself, and the STQ time pattern that was acquired during the short termed "chaotic behaviour" becomes a new reference basis for the recognition of future events. Thus, the CNS learns to record new events and experiences; and learns to evaluate time patterns which were unknown previously.

FIG. 5 shows a configuration in which the described invented method is applied to generate an autonomous self-organizing mechanism, in particular a robot, in which the STQ quanta are acquired by means of mechanistic sensor technology and electronic circuits. In contrast to FIGS. 4*a–f,* in the particular case shown here, nearly exclusive STQ(i) elapse times together with STQ(v) elapse times (which are required for the measurement of the relative instantaneous speed vm) are quantized. The time data streams, designated as Tω, are obtained from these vm-adaptive STQ(i) elapse time measurements. It would nevertheless be advantageous to acquire also STQ(d) quanta, which can serve to verify the recorded time data stream Tω.

In contrast to molecular/biological organisms, in mechanistic systems it is not possible to place a comparably large number of sensors adjacent to one other on narrow sites. It is therefore necessary to acquire as many STQ elapse times as possible from the available mechanistic sensor technology, in order to attain a sufficiently large reference base for the subsequent statistical analysis. It is also worth reiterating that, as described in FIG. 3*a,* in multiple STQ(i) quantization, parallel and simultaneous time data are produced, so that his data must also be processed in a parallel manner.

This figure shows a block diagram for a mobile autonomous robot that has the ability to reproduce motion sequences in an auto-adaptive manner, and to optimize the timing of its own motion sequences by continuous scanning and recognition of the physical surroundings. The robotic system is equipped with equivalent adjacent sensors 79 and 80, which produce analog output signals, and that are interconnected with threshold detectors 81*a,b,c,d,e* . . . and 87*a,b,c,d,e* . . . When sensor 79 (the "V-sensor") moves along the corresponding external signal source 78*a* in the designated direction, its signal amplitude first breaks through the lowest potential P1, which is determined by the threshold detector 81*a* (see description of FIG. 2*b*). The Flip-flop IC 82*a* (output set to=H ) is thereby triggered. (A Schmitt-trigger IC and a monoflop IC should be preadded in order to generate short pulses at each phase transition.) The subsequent resettable precision integrator IC (1) 83*a* provides a continually ascending analog output signal which modulates the output frequency *f* of the programmable oscillator IC (VCO) 84*a*. The frequency *f* is communicated to the input of a digital TICM (a multiple time counting and storing IC 86 (C1)) and whereby the current vm-adaptive time counting frequency fscan(1) (see also FIGS. 3*b,c*) is produced. The integrator IC (1) 83*a* therefore carries out the STQ(v) quantization It acquires the elapse time Tv(1) in the form of a potential increase, which is then converted by the VCO(1) 84*a* into a time counting frequency *f*scan(1), and which is inversely proportional to the relative velocities vm(n . . . ) with which the robotic system is moving relative to the spatial surroundings.

After the neighbouring sensor 80 (the "W-sensor") extends to the perception field of the signal source 78*a,* its signal amplitude first breaks through the lowest potential P1, which is determined by the threshold detector 81*a* (see description of FIG. 2*b*). As a result, the rising edge of the subsequent Schmitt Trigger IC 88*a* produces an impulse in the subsequent IC 89*a,* whereby the STQ(i) quantization of the vm-modulated elapse time Tω(1) is commenced in the TICM 86(C1). Because a reset pulse simultaneously goes to the Flip Flop 82*a,* causing the analog level of the analog output of the integrator(1) 83*a* to be held fixed, the pulse frequency *f*(1) persists as a momentary vm-dependent time counting base *f*scan (1) at the output of TICM 86(C1), and remains unchanged until the next STQ(v) parameter is quantized. This quantization happens whenever the signal amplitude of the sensor 79 drops below the potential P1, which is determined by the threshold detector 81*a* (whence the flip flop IC 82*a* is triggered by the falling signal edge), or when the sensor 79 expands into the perception field of another signal source 78*b,c,d,e* . . .

Simultaneously an impulse is again produced by IC's 87*a,* 88*a* and 89*a,* which stops the measurement of the elapse time Tω(1) in the TICM 86(C1), and stores the counted vm-modulated time pulses into the time data memory (C1). In the memory area C1 are stored the Tω time data that refer to the lowest potential P1; e.g. Tω(1), Tω(8), Tω(15) etc. Quantization of all STQ elapse times that refer to the higher potentials P2, P3, P4, P5 etc. is handled in the same manner as for P1. When the signal amplitude from sensor 79 passes through the threshold potentials P2, P3, P4, P5 . . . (determined by detectors IC's 81*b, c, d, e* . . . ), the outputs of flip flops 82*b,c,d,e* . . . are sequentially triggered to =H and therefore the subsequent integrator IC's 83*b,c,d,e* . . . generate continuously rising analog output levels, which serve to steadily decrease the frequencies *f*scan (produced by the VCO's 84*b,c,d,e* . . . ) until the signal amplitudes from sensor 80 goes through the higher threshold potentials P2, P3, P4, P5 . . . (determined by detector IC's 87*b,c,d,e* . . . ), when sensor 80 expands to the perception area of the signal source 78*a*.

As a result, the Schmitt trigger IC's 88*b,c,d,e* . . . are affected, and the mono flop IC's 89*b,c,d,e* . . . produce impulses that start the acquisition of vm-adaptive elapse time data Tω1,2,3,4, . . . , n in the TICM 86 (C2,C2,C3, . . . Cn). The recording of these data is carried out while the momentary vm-adaptive time counting frequencies *f*scan (1,2,3,4, . . . n) are valid, because simultaneously transmitted reset impulses to the flip flop IC's 82*b,c,d,e* . . . hold the output levels at the integrator IC's 83*b,c,d,e* . . . fixed, whereby the current output frequencies *f*(1,2,3,4 . . . n) are programmed at the VCO's 84*b,c,d,e* . . . In the same manner the consecutive quantization of further elapse times Tω takes place when the sensors 79, 80 move along subsequent signal sources 78*b,c,d,e* . . . All quantized STQ(i) time date are filed in the TICM 86(C . . . n). In the memory area C2 (see the corresponding FIG. 2*b*) are filed the elapse times Tω(2), Tω(7), Tω(14) . . . that refer to the perception area (potential) P2; in the memory area C3 are filed the elapse times Tω(3), Tω(6),Tω(13) . . . that refer to the next higher potential P3; in the memory area C4 are filed the elapse times Tω(4), Tω(5), Tω(12) . . . that refer to the next higher potential P4 . . . ; and so on. The Tω-sequences currently streaming into the TICM are generated by the current motion of the sensor-coupled autonomous mechanism (e.g. "robot vehicle") along some track. In the case shown, the positions of the sensors are temporally deviating according to the positions of the external signal sources (physical surroundings).

In the case of absolute physical invariance between the mobile robot system and the surroundings (socalled synchronism), no STQ parameter and no Tω-sequence can be acquired. If such physical invariance is not occurring, then it is possible for the autonomous vehicle to recognize its own motion along the track by continuous comparison of currently acquired STQ elapse time patterns Tω(1,2,3,4 . . . n) with prior recorded STQ elapse time patterns Tω'(nnnnn); and it is also possible for it to perfect the recognized motions continually in an auto-adaptive manner. A prerequisite for this is that the vehicle is equipped with a drive and brake system controlled by data which are calculated on the basis of continuous statistical time data analyses.

(Compare also FIGS. 3*d* and 3*e*): As soon as the regression curve of a currently recorded time data sequence Tω(1,2,3 . . . ) in the TICM 86 converges to the regression curve of a previously recorded time data sequence Tω'(nnnn) that was acquired through a prior similar motion on the same track, the drive system 98 (as well as the brake system 99) is actuated by impulses 96, 97, which induce the autonomous vehicle to perform its motion courses along the external signal sources 78*a,b,c,d,e* . . . in a manner such that the current motion course is temporally and spatially approximately isomorphic to that former motion course from which the referential time data sequence Tω'(nnnn . . . ) is derived. For this purpose, the TICM 86, in which the current time data are recorded, and the memory 92, in which the prior recorded time data Tω'(nnnn . . . ) are stored, are interconnected with a covariance analyser 90 and discriminator logic 91, which verifies the elapse time data and tests them for plausibility. Invalid time data are deleted and/or interpolated, whereby no breakdown of a data-supported servoloop can occur.

Analyzer 90 and discriminator 91 continuously scan the memory 92 with very high frequency to find approximately covariant time data patterns. Significant data sequences are transferred to the interpreter 93 that decides the respective probability density and the value of covariance. If significant covariance exists, then the processor 94 calculates the appropriate actuating data for keeping an isomorphic course of motion. These data reach the control module 95, where they are transformed into impulses 96, 97 for the drive and brake system 98, 99.

It is advantageous to extend this arrangement by incorporating energetic impulses for a steering and contra-steering system 100,101,102,103, that are based on the same functional principles as above, and that are required to keep to the spatial motion course determined by the same Tω time patterns as above. A prerequisite for perfect functioning of such an arrangement is the utilisation of extremely fast processors for the operation of the subsystems 90, 91, 93, 94, and 95. The current motion course of the autonomous vehicle can be made approximately isomorphic to the referential motion course only if the recognition of the significant Tω'(nnnn) sequences (i.e. the reference data), the recording and analysis of the current Tω sequences (actual data), the computation of the control parameters and the application of the energy impulses 96, 97 all occur nearly in real time. The vehicle would then display behaviour similar to a "power servoloop" of the known type. This similarity can be confirmed simply by increasing or decreasing the base frequency fn of the clock 85, whereby the entire temporal course in all motion phases is accelerated or decelerated, in an absolutely synchronous manner.

Each external intervention that tries to alter or disturb the motion course is counteracted automatically by the drive mechanism of the autonomous vehicle. Therefore, an autonomous mechanism working along these principles is comparable with a "live organism". Since in the system components 90, 91, 93, 94 and 95 a tendency is programmed that continuously optimizes the analysis and interpretation of acquired time parameters (for example, to allow only "authentic data"; i.e. those Tω'(nnnn) time data that pertain to the shortest and most efficient path to follow). In such a mechanism, there would then exist the tendency not only for temporal and motoric auto-adaptation, but also for optimization. (This is inherent in molecular/biological structures of organisms (see description to FIGS. 4*a–f*).) The system is also capable of determining priorities, as well as of deciding in favour of Tω time data sequences that correspond to some other regression curve, if an irregular track deviation that cannot be stabilized by the control module 95 is recognized; whereupon, for example, the vehicle emulates a new motion course and a new speed time curve (timing). The memory of the TICM 86 can store any alternative motion scenario in the form of Tω time data patterns, which are accessed if a certain course deviation makes it necessary to do so. In this way, crash situations are recognized as soon as the danger becomes apparent, and can be avoided, since the vehicle is ready to react in an autonomous manner. The system goes out of control ("chaotic condition") only when no segmental regression curve derived from prior recorded Tω sequences can been found that converges to a segmental regression curve derived from currently recorded Tω sequences. The author terms this process "motoric auto-adaptation", or "auto-emulation". In order to be able to identify temporal-spatial deviations of the physical surroundings from the subjective view of the autonomous system, it doesn't suffice in most cases just to scan external structures, land marks and light conditions by means of optical or photoelectric sensors passively. It is usually necessary to sense also height deviations by means of inclination sensors; uneven surfaces by means of pressure detectors or acceleration sensors; stationary acoustic sources by means of microphones; gradients by means of magnet field sensors; and positions by means of GPS; in order to acquire sufficient STQ parameters for a reference base.

All recorded Tω'(nnnn . . . ) time data streams are stored in the memory of the TICM. One can conclude from this that the adaptability and self-organisation capability of an organism (or autonomous auto-adaptable mechanism) increases in proportion to the quantity of all available sensors, or, respectively, to the number of STQ parameters that are available for the auto-adaptation process. Another important point is that in an autonomous system, there can be no timing without an accompanying time recording (=STQ quantization). Auto-adaptive processes and mechanisms of the described type will be indispensable for many future tasks in the high technology sector; for example, in the development of autonomous robot systems.

An example of such a task is the following. An automobile that must find its way through traffic autonomously, safely and efficiently, must be capable of holding lateral and frontal distance margins, as well as speed courses, fixed. This automobile, moreover, would have to be able to execute autonomous overtaking procedures, and to recognize dangerous situations in advance and avoid them. This is only possible if the onboard computer of the vehicle is interconnected with a multiplicity of different sensors that record a diverse variety of signal sources; and if the vehicle is equipped with extremely fast and efficient hardware and software that can process the STQ time data required for auto-adaptation, approximately in real time. Future types of microprocessors could be enhanced with hardware structures that perform the functions described above.

FIG. 6*a* shows a configuration of a simple embodiment of an aspect of the invention, in which the STQ(v), STQ(i), and STQ(d) quantization methods introduced in FIGS. 2*a–c* are applied to the recognition of spatial profiles or structures. In the application shown here, a robot arm, on which two adjacent metal sensors 104, 105 are installed at a distance b apart must be capable of distinguishing the profile of the metal rail 106 while moving at various speeds along any of the rails 106, 107, 108.

If the sensor head is moving at height h in the designated direction, then the v sensor 104 (S2), and then the w sensor 105 (S1) in turn, approach the low sensitivity area designated here as perception intensity zone 1. The lowest threshold value P1 is passed through by the signal amplitude, and the acquisition logic 109—mainly consisting of elements 81, 82, 83, 84, 85, 86, 87, 88, and 89 (shown in FIG. 5)—begins to acquire v-modulated STQ(i), STQ(d) time sequences Tω(1,2,3 . . . n) and Tδ(1,2,3 . . . n), which are stored in the TICM memory (A) 110. The same time data acquisition process recurs when sensors 104, 105 meet the next higher perception area zones 2 and 3, and when the signal amplitudes break through the potentials P2 and P3, which are preset in the threshold value detectors.

Within the analyzer 112, in order to identify the metal rails 106 unequivocally (which would thereby show the characteristic profile), Tω and Tδ time data streams flowing into the memory 110 must be continually compared with the particular significant Tω', Tδ' time data pattern (B) 111 that has been preprogrammed as a "reference" pattern. Invalid or irregular time data are recognized, then deleted or corrected by the discriminator unit 113. This unit is programmed with the capability of improving the allocation and processing of data automatically (e.g. verifying and checking the time data in an auto-adaptive manner) as was already described with reference to FIG. 5. If a profile has been "recognized", then the analyzer 112 transmits a confirmation signal to an actuator unit of the robot, which sets a mechanism in motion that lifts the identified metal rail up from the ground, puts it on a conveyor belt and so on.

FIGS. 6*b–e* show various diagrams and charts pertaining to FIG. 6*a*.

Figure 6B:
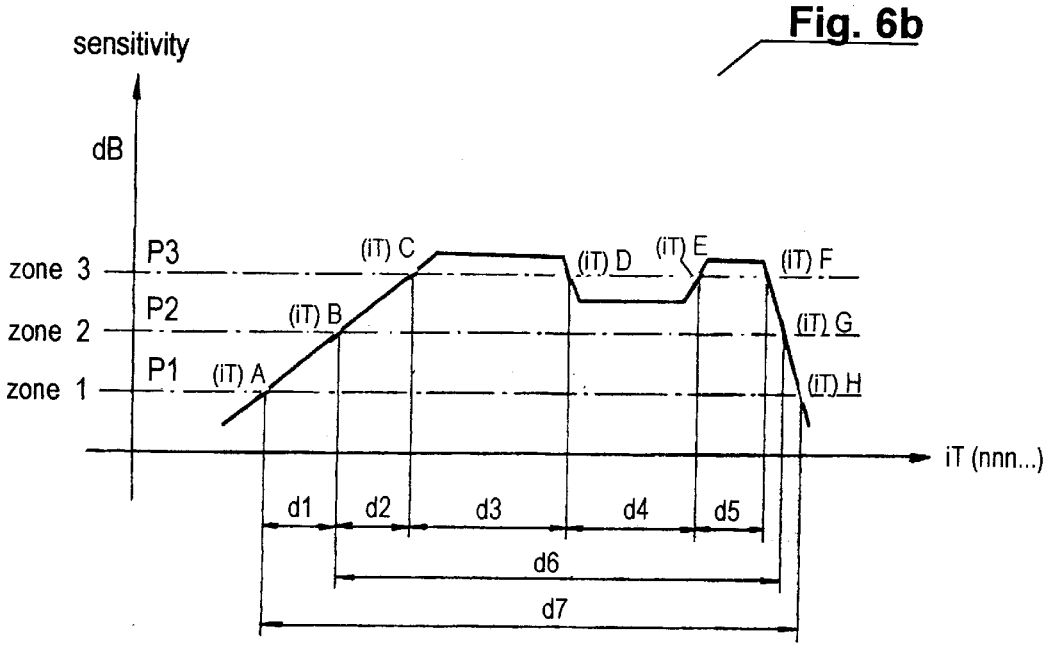

FIG. 6*b* shows a sensometric diagram of the scanned rail profile 106. The measurement of its dimensions d1 . . . d7 is effected exclusively utilizing STQ quanta, i.e. within the time domain. Three sensitivity zones P1, P2 and P3 are preset (in the threshold detectors as well) for profile identification. At the phase transitions (iT)A, (iT)B, (iT)C, (iT)D, (iT)E, (iT)F, (iT)G and (iT)H, digital precision timers are activated or stopped. Since the variable time counting frequency *f*scan with which these timers are counting is automatically adapted (modulated) by the current scanning velocity vm (see also FIGS. 3*a–g* and FIG. 5), the actual dimensions d1 . . . d7 correlate significantly with the Tω, Tδ elapse times that are already stored in the memory 110. As seen from the diagram, the distances AB→(d1) and BC→(d2) are obtained from STQ(d) elapse times; and the distances CD→(d3), DE→(d4), EF→(d5), as well as BG→(d6) and AH→(d7), are obtained from STQ(i) elapse times. It is to be emphasized once again that all of the (iT)n . . . are volatile phase transitions, and never "time points" in the classic physical understanding.

Figures 6C, 6D:
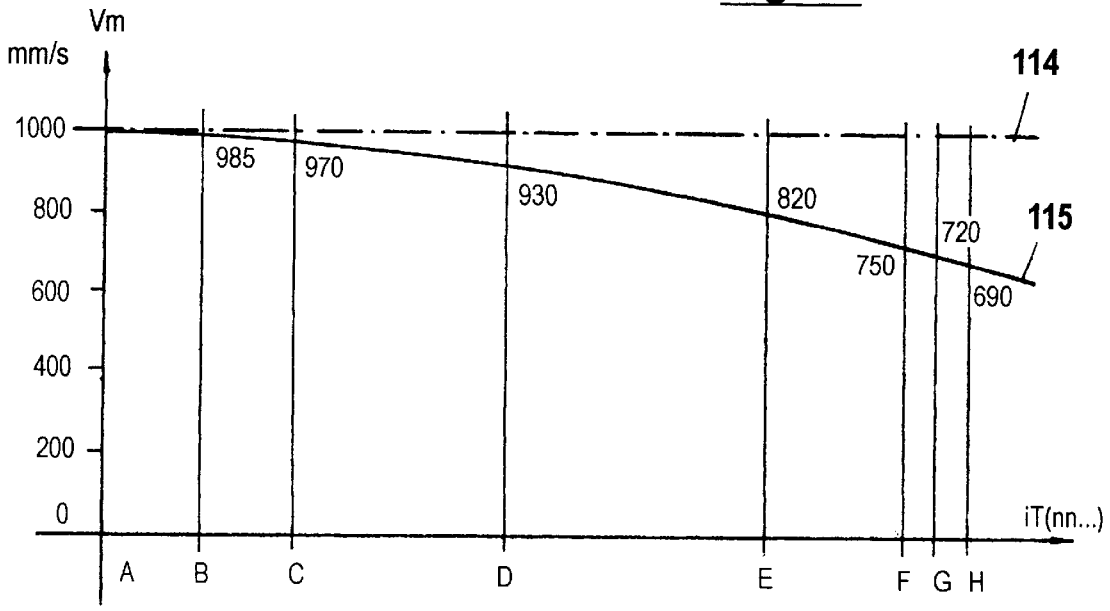

FIG. 6*c* shows vm diagrams of two motion courses of the sensors S1 and S2 along the metal profile being scanned. In the first case, the robot arm on which the two sensors are installed moves with an invariant speed of 1000 mm/s over the profile (dash dot graph 114). In the other case, the arm decelerates from a speed of 1000 mm/s at the first phase transition A to 690 mm/s at the last phase transition H. The deceleration is not linear, and is shown in the graph 115.

FIG. 6*d* shows a fictitious frequency and time data table for FIG. 6*c,* with a constant vm relative speed of 1000 m/s at all phase passageways (iT) A . . . H. Consequently, the vm-modulated time counting frequency *f*scan is 10 kHz during the entire scanning process. Because, in the case shown here, the recording of STQ(v) elapse time takes place with a fixed clock timing base of 200cs/b, the scanning process leads to vm-adapted STQ(d) sequences of 273cs, 738cs, 620cs and 262cs for distances AB, BC, CD, DE and EF and to vm-adapted STQ(i) sequences of 1876cs and 2200cs for the distances BG and AH. The current Tω-Tδ sequence, consisting of vm-adapted STQ(d) and STQ(i) elapse times, is compared in the analyser 112 with the referential stored Tω'-Tδ' sequence 270, 270, 740, 620, 260, 1880, 2200, which serves as the significant time pattern, for this metal profile, that is already stored in the memory 111. If the analyzer decides that "covariance" is occurring, then a confirmation signal is transmitted to an actuator unit. The analyzer consists of comparators and/or "fuzzy logic"-IC's which ignore scattering in the boundary values (for example, decimal places are rounded up). Apart from these correction measures, tolerances, plausibility criteria and allocation criteria can also be programmed by software.

FIG. 6*e* shows the same frequency and time data chart as FIG. 6d, but with variable scan speed course (vm). The relative velocity of 1000 mm/s at phase transition (iT)A decreases to 690 mm/s at the last phase transition (iT)H. The vm deceleration is not linear. In accordance with the graph 115, at the phase transitions (iT) A,B,C,D,E,F,G,H, the momentary speeds (vm1,2,3 . . . ) are measured to be 1000, 985, 970, 930, 820, 750, 720 and 690 mm/s. The vm-adaptive modulation of the time counting frequency *f*scan(1,2,3 . . . ), described above, produces phase transition values of 10, 9.85, 9.70, 9.30, 8.20, 7.50, 7.20 and 6.90 kHz, which are then used to quantize the STQ(i)- and STQ(d) elapse times. Since the STQ(v) quantizations also take place with the clock time base 200cs/b, the same Tω-Tδ elapse time sequence for the distances AB, BC, CD, DE, EF, BG and AH results, as seen in the chart of FIG. 6*d*. It is obvious from this chart that the recognition of the metal profile is guaranteed, whether the vm speed course is linear or not.

FIGS. 7*a–d* show various configurations of sensors used in the quantization of STQ(v) elapse times, or for the recording of the relative speed parameters (vm), respectively. The first three configurations show sensor constellations for 2-dimensional records of external events. FIG. 7*d* shows a special configuration applicable for random 3-dimensional records of the physical surroundings.

FIG. 7*a* shows a sensor constellation in which a bearing, carrying the sensors S1 and S2 on the same axis at a distance b apart, moves itself in the designated direction along an arbitrary track; or rotates itself about a point in space that is equidistant from both S1 (V-sensor) and S2 (W-sensor). This sensor system has only one degree of freedom.

FIG. 7*b* shows a sensor constellation in which a supporting surface, carrying on the same axis two V-sensors S2 and one W-sensor S1 equidistant from each other as shown, moves itself arbitrarily in either of the two opposite directions shown along some arbitrary track; or rotates itself about a point in space that is equidistant from the v-sensors S2. The sensor constellations shown in FIGS. 7*a* and 7*b* are sufficient for most robotic applications in traffic technology.

FIG. 7*c* shows a configuration with a number of equivalent v-sensors S2 arranged as segments around a central w-sensor S1 on a circular supporting surface having radius b. In this constellation, the supporting surface can move itself in any direction in the plane on an arbitrary track; or can rotate itself about a point in space that is at any distance from the sensors. This sensor configuration therefore has 2 degrees of freedom.

FIG. 7*d* shows a sensor configuration with a number of v-sensors S2 arranged as segments on a spherical supporting surface, with radius b, around a central w-sensor S1. The sensor constellation can move itself to any arbitrary position in 3-dimensional space, or can rotate in each direction around a solid spatial point A at arbitrary distance from the sensors. This configuration has 3 degrees of freedom. The sensor constellations shown in FIGS. 7*c* and 7*d* come into consideration primarily for autonomous reconnaissance robots or flight objects, wherein energetic impulses could be applied in an arbitrary direction (e.g. by means of auxiliary rockets).

FIGS. 8*a–f* illustrate the configuration and functioning principles of a further embodiment of the invention presented herein, in which the STQ quantization methods described in FIGS. 2*a,b,c* are used to create an autonomous auto-adaptive self-organising training robot for use in sports; a so-called "electronic hare". This system has autonomous brake, drive and steering mechanisms, and an analyzer that continuously compares the currently recorded vm-adaptive STQ(i)- and STQ(d) time data patterns Tω and Tδ(1,2,3 . . . ) with previously recorded vm-adaptive STQ(i)- and STQ(d) time data patterns Tω' and Tδ'(1,2,3 . . . ), respectively, which serve as reference patterns. It is thereby capable of reproducing and optimizing a motion course that has been pre-trained by the user; of automatically finding ideal routes and speeds; of keeping distances and times; of recognizing and warning of dangerous situations; and of representing its own motion, as well as information about speed, lap times, intermediate times, start to finish times, and so on, on a monitor. It is, moreover, capable of outputting these data in an optical or acoustic manner.

Figure 8A:
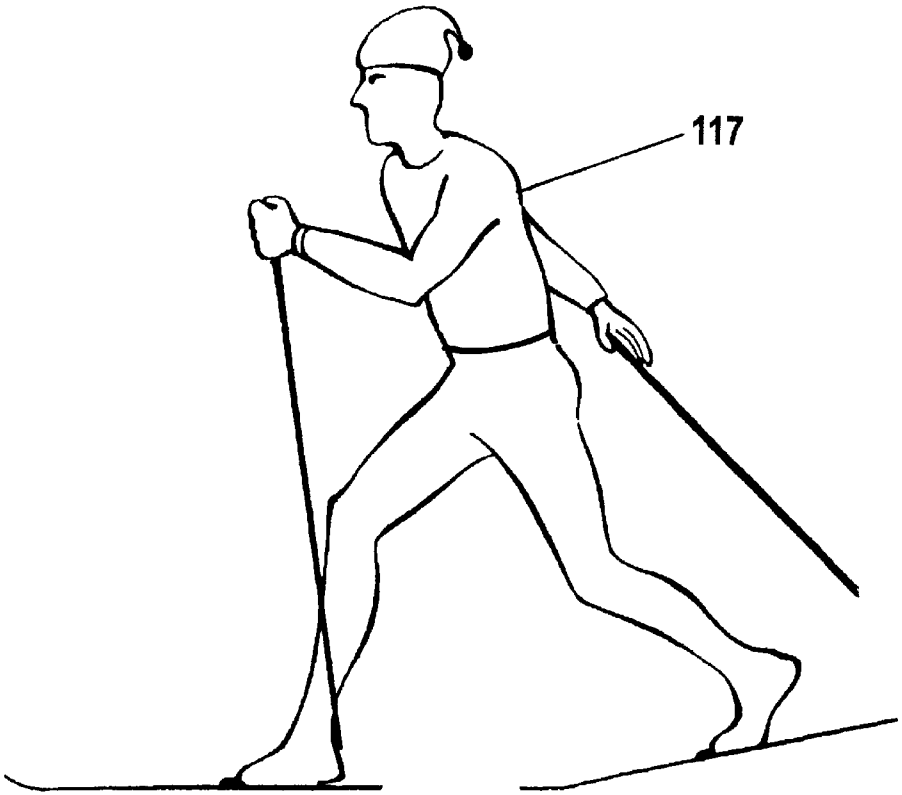
Figure 8A:
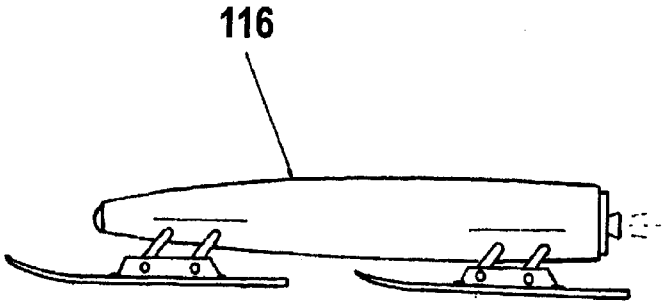

FIG. 8*a* shows a training robot 116 in front of a long distance skier 117. The robot vehicle envisaged for this application would be fitted with a ski undercarriage, allowing it to move with ease along snow-covered ground. It must be reasonably manoeuvrable in order to be able to match a human skier travelling in a long loop. The robot must be also able to create a new track on the same route where the former one has been covered by snow, and is therefore no longer visible. The training robot is especially suitable as an aid for blind skiers. The autonomous vehicle recognizes skiing circumstances for the blind skier, speaking out aloud hints, reports, warnings and so on by means of speech synthesis, which frees the skier and allows them more enjoyment. The robot vehicle 116 has a large number of sensors and electronic components, in the manner introduced in FIG. 5. It performs the same motion emulation, auto-adaptation and auto-optimization, often carrying out several practical tasks simultaneously. It acquires vm-adapted STQ(i)- and STQ(d) elapse time patterns from a multiplicity of sensors, compares these patterns with corresponding reference time patterns, selects the significant time data, and analyses and calculates parameters for the discrete energy impulses that manipulate the drive, brake and steering mechanisms. In the following, the essential components of the system, comprised of any of three specific types of sensors (optical, magnet field or GPS-positioning sensors) are described.

Figure 8B:
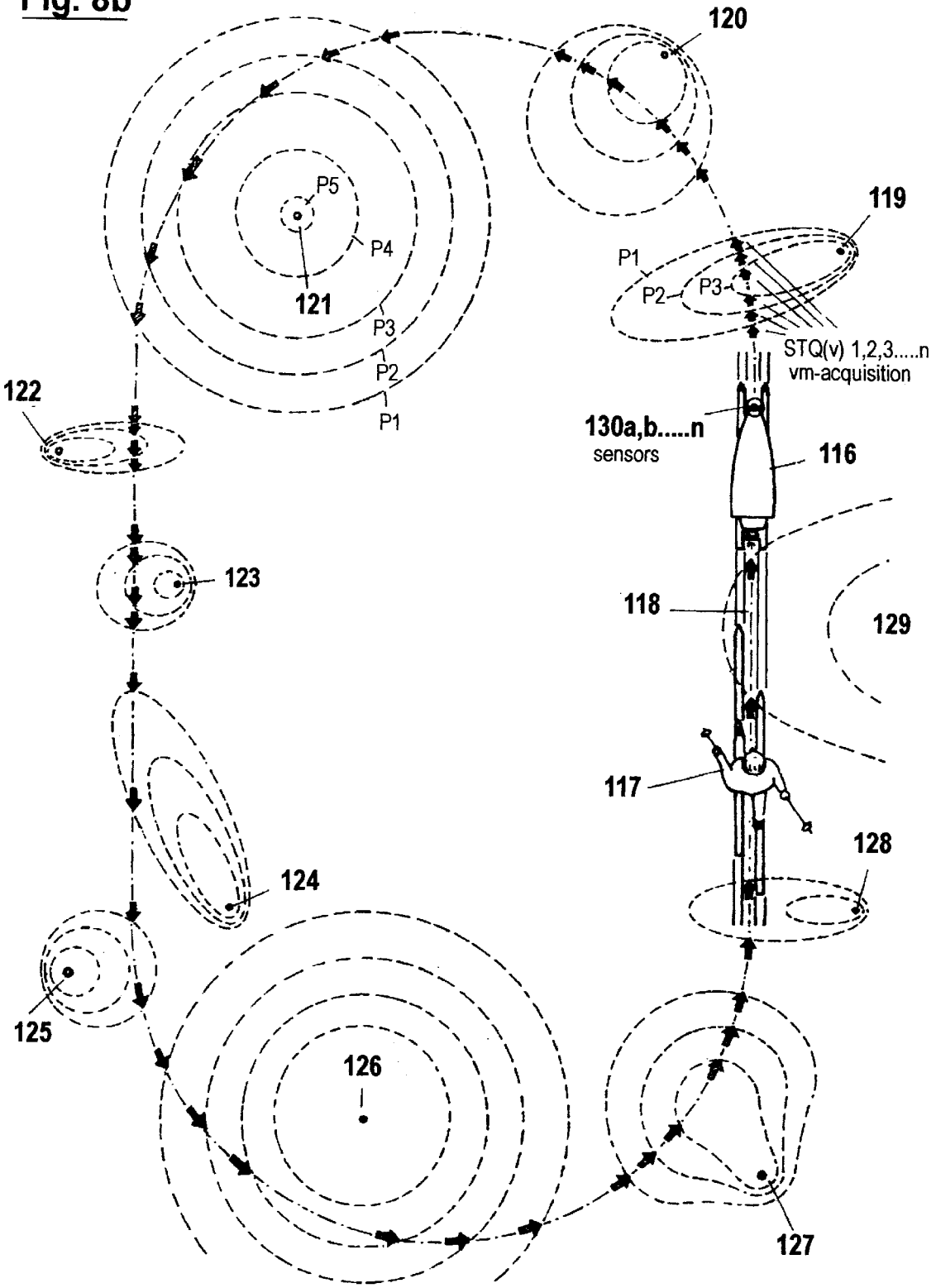
Figure 8C:
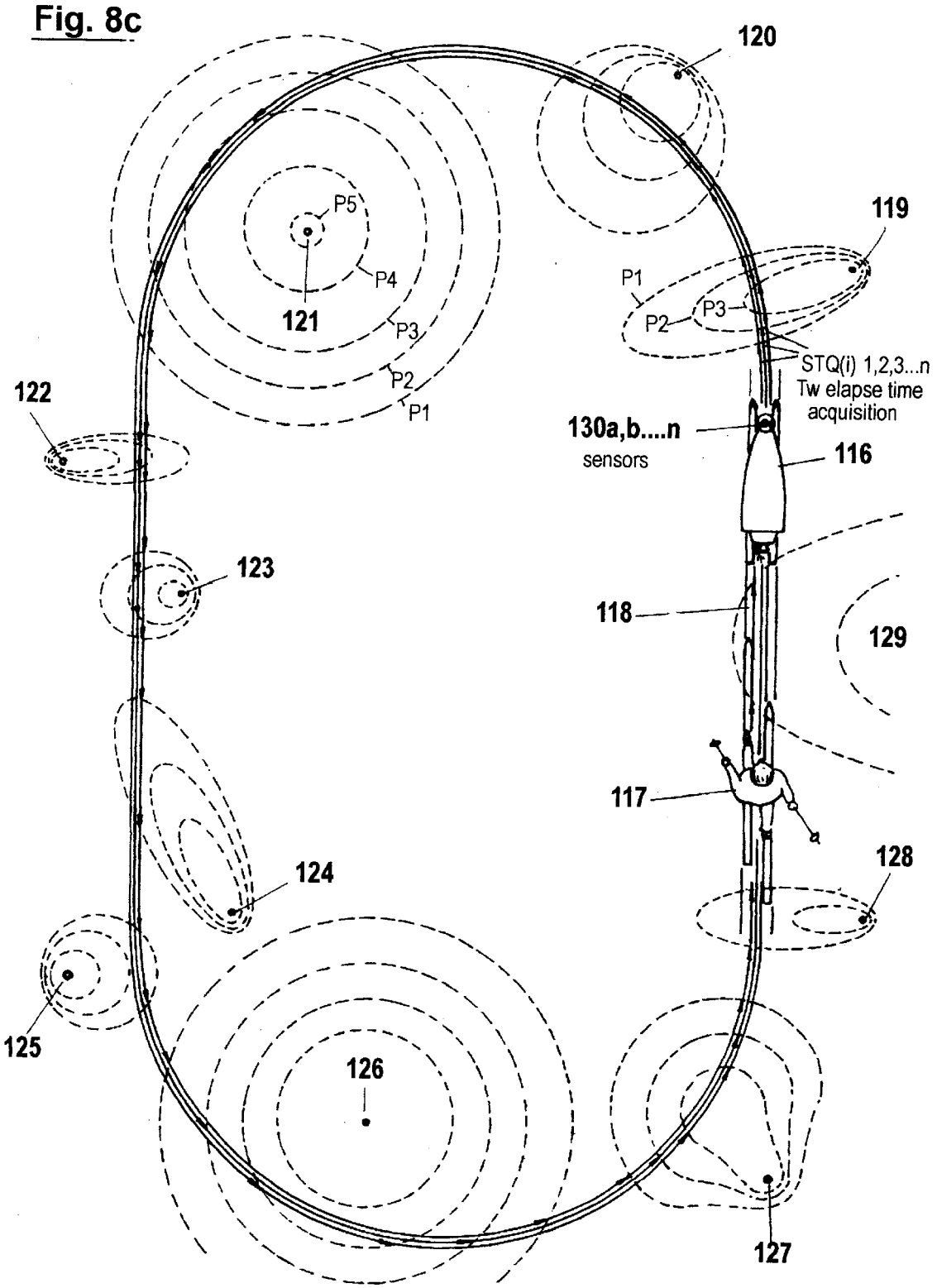
Figure 8D:
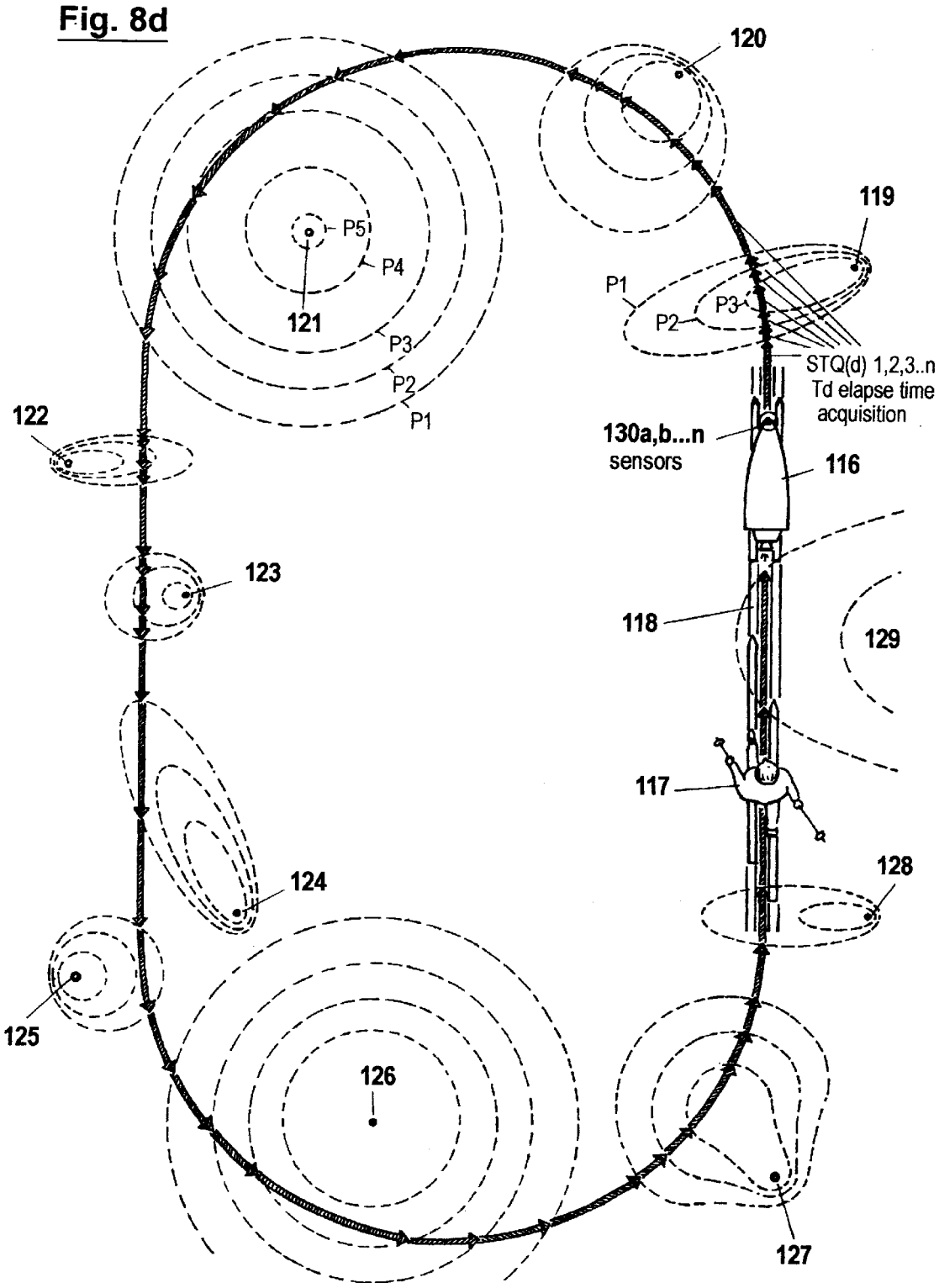

FIGS. 8*b–d* illustrate the recording of STQ(v), STQ(i) and STQ(d) elapse times (pertaining to FIG. 8*a*) with use of optical or acoustic sensors. The fundamental principles of its function have already been detailed in the description of FIGS. 2*a–c* and FIG. 5. In the present figures, the training robot (the "electronic hare") 116 is moving with variable speed in front of a long-distance skier 117 in the loipe 118. Optical or acoustic signal sources 119, 120, 121, 122, 123, 124, 125, 126, 127, 128 and 129 have been placed along the track in some arbitrary configuration, which are perceived by the corresponding sensors 130*a,b,* . . . , n. At each phase transition through the threshold zones P1, P2, P3, P4, P5 etc., the designated STQ(v)-, STQ(i)- and STQ(d) elapse times are recorded. They generate the current vm-adaptive Tω'-Tδ'(1,2, . . . n) time data pattern, which is stored in the TICM. It is not crucial that the signal sources be fixed (e.g. they may be spotlights that illuminate the track for evening events). Signal sources can also be produced through differences in light intensity, contrast or colour, occurring beside trees, masts, buildings, slopes or significant land marks in daylight. Headlights could even be installed on the training robot itself, whereby the optosensoric recording of the reflected light and the evaluation of the light structures of the spatial surroundings may be used for recognizing its own motion. The same set-up may be used also with ultrasound sensors. On the other hand, acoustic signal sources could equally well be of natural origin; for example, the sounds of a brook running beside the loipe, or a waterfall.

Generally, any volatile combination of light and shadow, or any noise source, can be decisive in the recognition of a certain object. The particular identity of the object may be determined by comparison of vm-adaptively recorded STQ (i)- and STQ(d) elapse time patterns with the Tω'-Tδ'(1,2,3 . . . n) patterns, which are stored in the TICM and which represent each individual external object. In order to simplify the present description and demonstration, it is assumed that the signal sources 119 . . . 129 in FIG. 8*b* are lamps installed along the robot's route, making it possible for the robot to use the loipe at twilight or in darkness. According to the primary domain of application of such a robot, the training robot 116 skis with precision behind the skier 117 along the skier's track, with all STQ time data vm-adaptively recorded and stored in the TICM working memory (see also FIG. 5). The distance between robot and user is precisely controlled by a distance sensor. However, in order to be able to invoke the robot vehicle's drive, brake and steering mechanism, STQ time data that could serve as reference data must already have been loaded into the TICM prior to the journey. Therefore, as a first step, the acquired time data are stored in the TICM reference memory; i.e., Tω-Tδ(1,2,3 . . . ) are mapped to Tω'-Tδ'(1,2,3 . . . ) initially. Subsequently, the emulation of the skier is repeated several times, with increasing processing speed as the robot learns more about the skier, and with variable speed and track courses; whereupon more and more covariant Tω'-Tδ' time data patterns are contained in the reference data memory, which the robot's discriminator and analyser can access (see also FIG. 5).

The interpretation and optimization program is put into action, which filters through only "authentic" Tω'-Tδ' time data that are deemed to pertain to the best and most efficient trajectory of motion, and which eliminates at the same time those data recognized as "irrelevant". This resembles a "learning process" that the robot vehicle has to undertake until it can finally ski "autonomously"; i.e. relatively freely, and in accordance with self-appropriated patterns and self-decided criterions, without any remote control or regulation by a pre-programmed algorithm. Upon reaching this stage, the training robot functions as a "trainer" or "pilot" who has the task of helping the user find ideal speeds, the best track and optimal timing. This optimal information that is communicated to the user is only that which has been learned by the robot itself.

The training robot continues to improve itself also during this "practical work" (i.e. while helping the user), in continually optimising and supplementing the STQ reference data stored in the TICM. The ability to identify and recognize trajectories of motion or external signal courses and objects is always upgradeable. It depends on the quantity and variety of sensors used, as well as on the memory capacity of the TICM. Thus it is possible to induce the robot vehicle to recognize dangerous situations and to warn the user acoustically or optically; and to keep distances and times more exactly. In the present application, the vehicle performs automatic tracking and motion emulation along a loipe, even if the original track has been covered by snow and is no longer visible. Additionally, the robot vehicle has a monitor on which its own motion relative to its spatial surroundings can be visualised; as well as electronic measures to output speeds, lap times, intermediate times, total times or other relevant data in an optical or acoustic manner. An essential property of the robot vehicle shown here is that a simple adjustment (increase or decrease) of the central clock frequency can synchronously accelerate or decelerate the entire temporal course of all motion components (see also FIG. 5). For instance, this property is necessary in order to adapt the speed of the training robot in all sections according to the physical fitness of the user. This can happen manually by a remote control device, or automatically; for example, by a frequency or blood pressure data transponder.

Figure 8E:
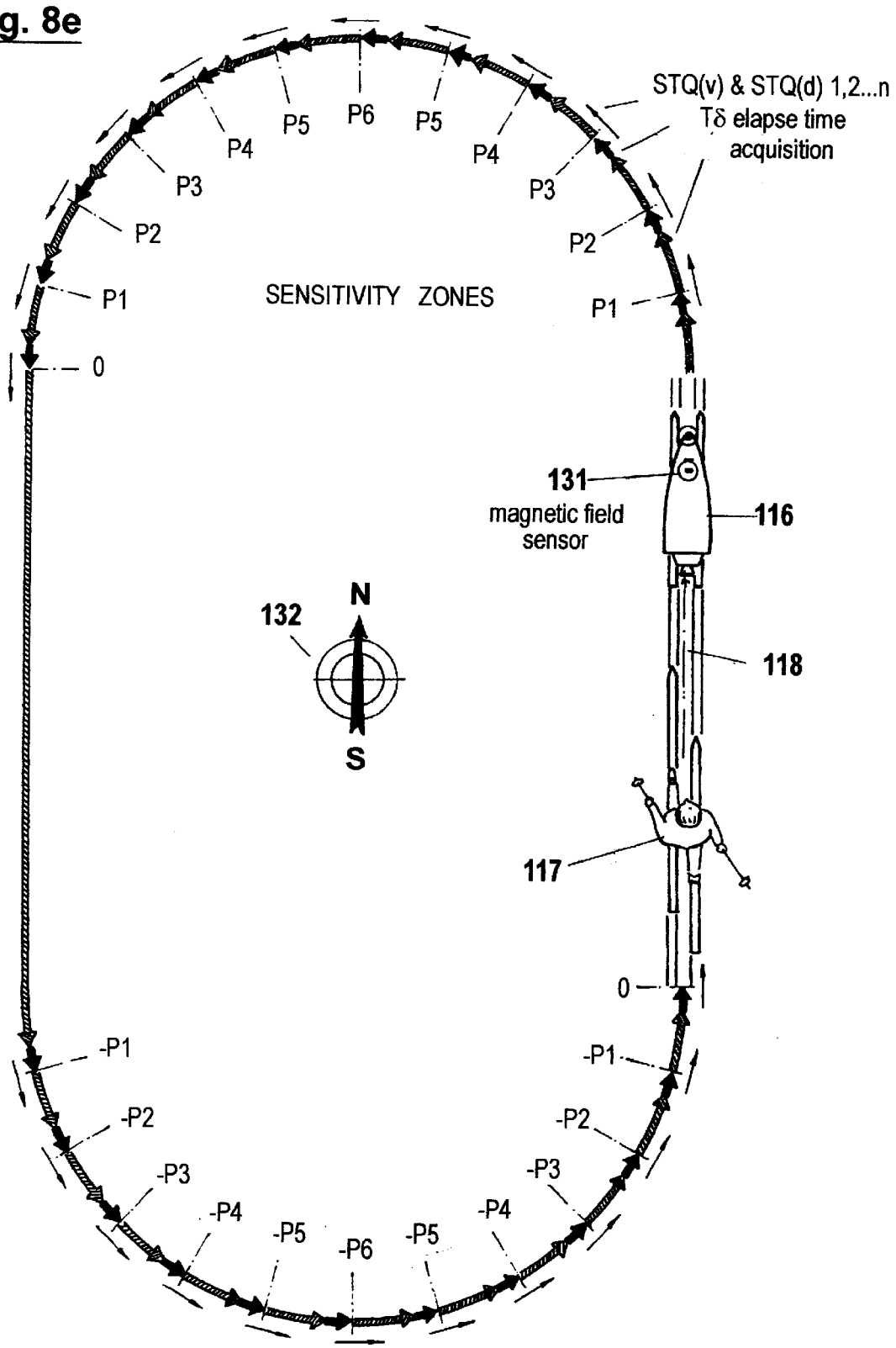

FIG. 8*e* shows the recording of STQ(v) and STQ(d) elapse times for the robot in FIG. 8*a* in the case when magnetic field sensors are installed. The signal source here is assumed to be the earth's magnetic field. In the example shown here, where the track forms a closed loop, the quantization of STQ(i) elapse times is inefficient, and therefore not undertaken. In the illustrated picture, the training robot ("hare") 116 is moving autonomously with variable speed in front of the long distance skier 117 along the loipe 118. Various vehicle position readings are produced along the track, with variable gradients to the earth's magnetic field 132. The magnitude of these gradients are acquired by the magnet field sensor 131. In this particular example, the magnitude follows a sinusoidal course. At each phase transition to the threshold zones P1, P2, P3, P4, P5, P6, and so on, the STQ(v) and STQ(d) elapse times are vm-adaptively recorded, which provides the current Tδ time data pattern that is stored in the TICM. The additional quantization of STQ elapse times from magnetic field gradients helps to locate covariant Tω'-Tδ' time patterns that are stored in the reference data memory. Consequently, the auto-adaptation and recognition capability of the robot vehicle is improved. The more sensors involved in the auto-adaptation process, the more "autonomous" is the described mechanism (see also FIG. 5). A self-organizing, autonomous organism based on biological or chemical structures, as discussed in FIGS. 4*a–f,* can be produced in this manner.

Figure 8F:
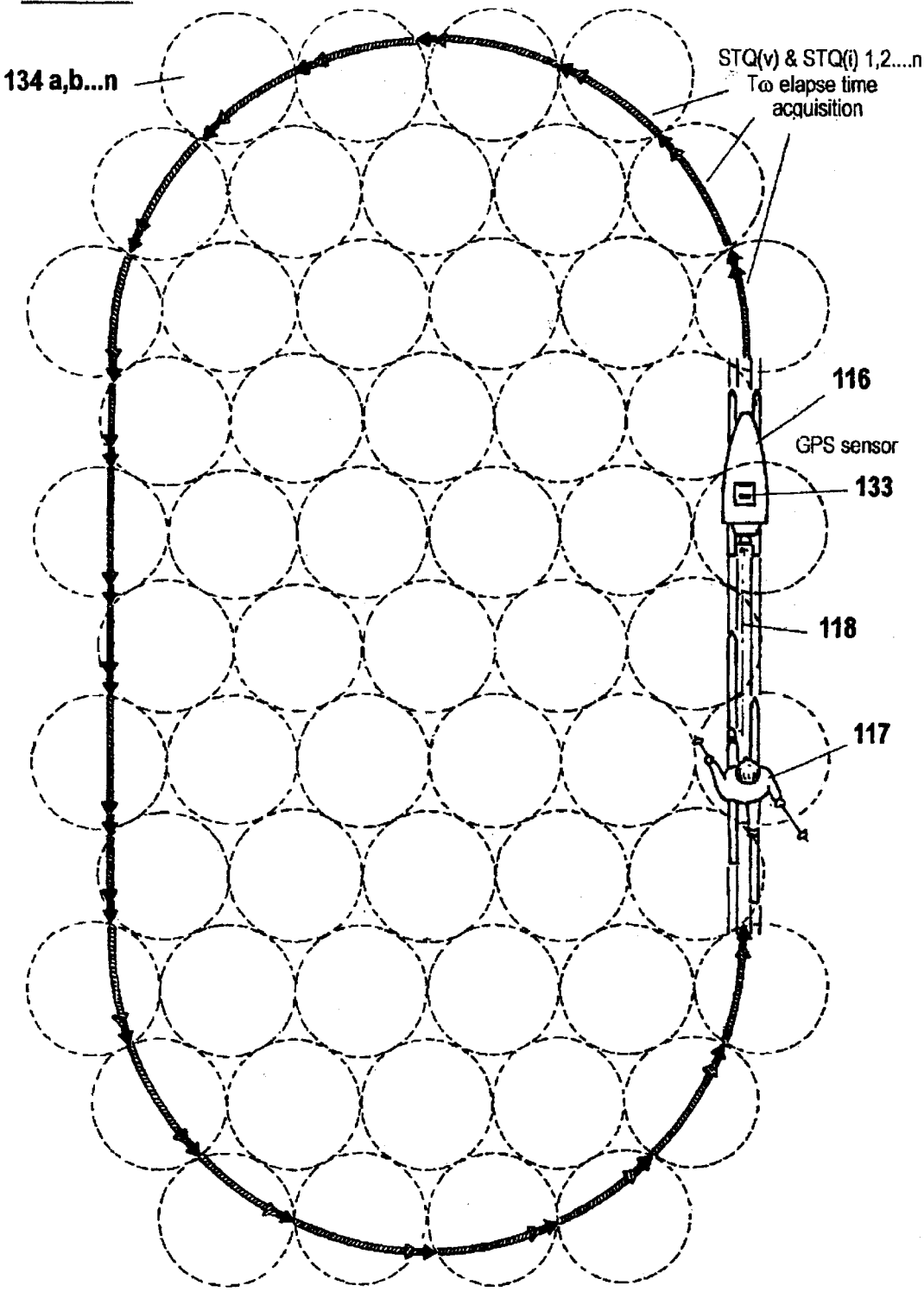

FIG. 8*f* shows the acquisition of circular position fields by means of GPS sensors. These measurements (in addition to those shown in FIGS. 8*b–e*) are used to improve temporal and motoric auto-adaptation and make auto-covariance behaviour and motion emulation more precise. A prerequisite for successful function is a GPS ("global positioning system") of high quality, which operates with extremely low errors. Since a square wave signal is received in this case (therefore no subdivision into distinctive sensitivity zones is possible) only STQ(v) and STQ(i) elapse times, but no STQ(d) elapse times can be quantized—which, as we have seen, are measured between phase transitions from lower to higher potentials, and, respectively, vice versa. In FIG. 8*f* the training robot ("hare") 116 moves itself with variable speed in front of the long distance skier 117 along the loipe 118, while circular GPS position fields are produced along the track 134*a,b, . . , n,* which are perceived by the GPS sensor 133 with high precision in a reproducible manner. The radii of the position fields, as well as the resolution between adjacent fields, is adjustable. With each detection of a new position field, a trigger signal is transmitted to the STQ acquisition unit, which records the STQ(v) and STQ(i) elapse times, and which then stores these currently vm-adaptive recorded time data sequences Tω(1,2,3 . . . ) into the TICM. The ability of the robot to otimize auto-adaptation can be aided by counting and comparing the number of detected position fields, or by assigning a specific data code to time data within each crossed position field.

FIG. 9 is a schematic diagram showing how time data streams are produced. Each transition of the amplitude through sensitivity zones or threshold potentials in redundancy-poor autonomous self-organized systems (such as mechanistic robot systems or organisms) leads to the quantization of elapse times, if these systems are equipped with sensors (or receptors) that are adequate for the perception of the external physical surroundings. It is asserted that the core technology shown in the diagram has universal validity and applicability. The diagram shows a highly simplified scheme for the technology, which can be understood plainly by a non-expert The principles of this invention, as represented schematically in this diagram, are summarized below:

1) The "primary act" of every autonomous organism (including autonomous self-organizing robots) is to "explore" their surroundings in order to ascertain whether temporal-spatial variation exists between its own physical state and that of its surroundings. In order to do this, a multiplicity of sensors or receptors 135*a,b, . . . , n* are necessary.

2) Only when deviation exists, are the current STQ elapse times Tω(1,2 . . . n) or Tδ(1,2 . . . n) 137*a,b, . . . , n* derived. The time counting frequency of their measurement depends on currently acquired STQ(v)-quanta Tv(1,2,3 . . . n) 136*a, b,c, . . . n,* which represent parameters for the temporal-spatial variations vm(1,2 . . . n) between sensors 135*a,b, . . . n* and external signal sources. These deviations are identical to the "relative speeds" vm(1,2, . . . , n). Note: vm(1,2, . . . , n) are always acquired by means of an invariant time counting frequency f, respectively, at an absolute time base.

3) The current STQ elapse times Tω(1,2 . . . n) or Tδ(1,2 . . . n) flow into so-called "information pots" 138 (or time data memories) and form STQ time data patterns Tω'(1,2 . . . n) or Tδ'(1,2 . . . n), which serve as reference patterns. If the organism finds sub-sequences of these Tω' or Tδ' patterns which in some combination are covariant with a currently recorded Tω or Tδ pattern, then the organism interprets these combinations of sub-sequences as an "isomorphous pattern" significant for defining the "actually perceived event-pattern" (i.e. what actually is). In this way, the present event (represented by temporal or spatial deviations between sensors and external signal sources) is "recognized".

4) An organism is equipped with "actuators" that influence a self-referential change—that is concurrently being recognized—in an organism's temporal-spatial condition (e.g. its own motion) in such a manner, that the change is highly covariant with a prior recorded pattern of change of a temporal-spatial condition (it emulates the prior pattern). Because the shortest and most efficient time patterns have a tendency to be of high priority while new Tω or Tδ sequences are being recorded in the memory, organisms continuously try to optimize changes in temporal-spatial conditions. Both processes result exclusively from comparison of quantized STQ elapse times and from recognition of isomorphous time data patterns (see also FIG. 5), and are termed "auto-emulation" and "auto-optimization"; or, equivalently, "autocovariance behaviour".

4) An essential consequence of these considerations is that a teleological tendency inheres in all organisms of the described type, towards auto-adaptation and auto-optimization. This generates the ability for self-organisation.

As seen from FIG. 10, both "time" and "velocity" unequivocally depend on the existence of sensors for their perception. Actually, all time data and information flow from the "present" (the origin of the recording) into the "past" (the verifiable existence). Indeed, time and velocity are not "sensed" as a continuum, but in the form of quanta. In order to feel both physical quantities as a continuum, an enormous capability for auto-adaptation and auto-emulation is required of an organism. It can be said that the above fundamental principles are valid not only for robotics and biological units, but also for molecular, atomic and sub-atomic structures. Also, these have to be "time sensing organisms"; otherwise they can have no basis for existence. Consequently: time, space—every physical quantity—cannot exist without subjective sensing of it. Viewed objectively, existing in the universe are only sensorial together with distinct sensitivity zones; and these form the basis for local subjective time sensing together with a general universal tendency for auto-adaptation, auto-optimisation, and auto-emulation. This is a fundamental teleological principle.

FINAL SUMMARY

1) The herein described invented method is universally applicable and describes the ultimate achievable state of technology.

2) Discrete time quantization methods, according to which the received signal is scanned and digitized at predetermined points in time, prove themselves to be inadequate in the generation of highly efficient autonomous self-organisation processes.

3) In redundancy-free autonomous self-organizing systems, there are no "points in time" and there is no determinism. In these systems, STQ elapse times are quantized which are derived from the temporal-spatial changes in physical conditions between sensors and external sources.

4) Each such system has its own time counting pulses and produces its own time. The time counting frequency for the quantization of elapse times is continuously adapted in an auto-adaptive manner according to the relative velocity vm with which changes in condition occur. The time recording has in each case a quantum nature; i.e. it has the properties of a "discrete counting", no matter whether the recording is analogue or digital. Moreover, the time recording is subjective and passive; i.e. the time quanta are "sensed" and not "objectively measured" as in the conventional physical understanding.

5) In order to be able to quantize elapse times in autonomous self-organising systems, the individual receptors or sensors must have distinctive grades of perception zones (or threshold values).

6) In order to explain precisely the difference between "synchronism" (in the conventional understanding) and "auto-adaptation", we define the following:

a) parallel synchronism (i.e. "synchronism"): this occurs when temporal changes of physical conditions of different systems are covariant at the same time.

b) autonomous adaptation (i.e. "auto-adapation"): this occurs when temporal changes of the physical state of a particular system are covariant at different times.

7) In all redundancy-free autonomous systems the capability for self-organisation increases with the quantity of elapse time parameters available for autonomous adaptation and for optimization process, as well as with the number and variety of sensors or receptors.

8) With synchronism (definition 6a above), the number of quantized elapse time parameters vanishes; in 3b this number is a maximum (and point 7 above is valid!). Therefore one can conclude that there is an inherent tendency in all autonomous systems of the type discussed herein, towards continuous auto-adaptation, auto-optimization and auto-emulation. This is similar to the biological term "vitality".

9) In autonomous self-organizing systems, there is no "timing" (i.e. temporal motion coordination) without the comparison of currently acquired elapse time patterns with previously recorded elapse time patterns. Briefly stated, there is no "timing" without accompanying "time keeping".

10) Auto-adaptation theorem of Bieramperl:

Every current non-chaotic change (A) in condition of an autonomous system (X) with the variable dynamic trajectory vm(1,2,3 . . . n) underlies a currently acquired sequence of elapse times Tω(1,2,3 . . . n) as well as a covariant sequence of elapse times TΩ(1,2,3 . . . n) from a temporal displaced condition change (A') or from a combination of distinct temporal displaced condition changes (A1')(A2') . . . (An'), whereupon (A) with (A') or (A) with (A1') (A2') . . . (An') are approximately isomorphous.

Hence:

TΩ=vm adaptively acquired current STQ(i) or STQ(d) elapse times Tω or Tδ

TΩ'=vm adaptively acquired covariant STQ(i) or STQ (d) elapse times Tω'or Tδ'

Other consequences in the scientific domain are the following.

11) Each preselection of a certain time for an intended action, a so-called "act of free will" by an autonomous organism, results from continued autonomous adaptation of the described type, and is therefore not realizable in a deterministic manner.

12) From the ability of an autonomous system to find previously acquired elapse time patterns matching with currently acquired elapse time patterns, and from trying to emulate these, not only is auto-adaptation, auto-optimization, self-organisation and recognition of physical surroundings and self-motion made possible, but ultimately also motion co-ordination (timing), intelligent behaviour and conscious action are produced.

13) Auto-adaptive, auto-optimizing and self-organizing processes of the described type have universal validity not only in autonomous mechanistic systems, robots, automatic machines and biological organisms, but also in molecular and atomic structures. All autonomous self-organizing systems contain information in form of time data.

The following results from the property that in such systems, "time" is "subjectively sensed" and not "objectively measured":

14) In the universe, all time dependent physical values are "subjectively sensed". If there is no adequate sensorium for time and velocity, then "time" cannot exist objectively. Example: in "black holes", no "time" exists because there is no sensorium for it. In this case, the atomic and subatomic sensorium is quasi "dead". Each change of physical condition, which does not underly an auto-adaptive process, continues increasingly chaotically; whereupon it follows that the described tendency for auto-adaptation in the universe counteracts the tendency towards entropy and chaos.

15) If vm is too high and STQ(v) is too short to be measured (or "sensed"), then neither an auto adaptation nor any self-organization process results (because no elapse times are derivable). Therefore, for example, the velocity c of propagation of light is an "ultimate value", because it implies the shortest STQ(v) quantum that can be "perceived" by atomic structures.

16) If there is absolute physical invariance between the sensorium of autonomous systems and their surroundings, then also no STQ quanta are derivable. This is the reason why, for example, absolute zero (273,15° C.) is an ultimate physical quantity. In this case, the atomic and subatomic sensorium is not capable of recognizing a lower temperature because of lack of STQ quanta, and no autoadaptation process can take place.

17) As mentioned before, atomic and subatomic structures also display sensory and time quantization properties. Their description from the view of quantum theory is inadequate. If there is no measurement or observation of an event, then exists also neither "time" nor "velocity" (S. 13). Quantum phenomena appearing in the known two slit experiment or in the SCULLY experiment (quantum indeterminism) are explicable in this way.

18) The electromagnetic force, gravitation, the strong and weak interaction (nuclear force), so-called "autocatalysis" (KAUFFMANN), "synergetic effects" (HAKEN), or other phenomena are produced by the existence of time quantization sensorium, auto-adaptation and auto-emulation. These features can be regarded as the inherent teleological principle of the universe (S. 8).

19) The ability to perceive time and velocity as a continuum, and not as an endless series of sensed elapse times, is likewise produced from continued auto-adaptation and self-organization processes. The higher the "intelligence" of an autonomous system as a result of such processes, the more distinctive its subjective time perception and its ability to anticipate.

Consequences for metamathematics, propositional calculus, epistemology and philosophy are:

1) Because there are no deterministic point of times, the status of a system can neither be ascertained to be at a certain "point in time", nor "points in time" can be determined for a future status. There is nowhere any type of determinism. Since the classical physics as well as the quantum theory are based on the postulate that a system is in a certain status at a certain "point in time" (in the first case as points of phase space, and in the other case as probability distributions in phase space), neither theory can be completely consistent (see also THOMAS BREUER/1997).

2) Regarding WIGNER (1961), an absolutely universally valid theory would have to be capable of describing the origin of human consciousness. The auto-adaptation theory described herein could be capable of this; the quantum theory cannot (Wigner postulated that complex quantum mechanics delivers a usable description of the physical reality only when there is no "subjective sensing". The author holds the view that subjective sensing also exists in atomic and subatomic structures.)

3) Sequences of elapse times like TΩ and TΩ' are definable as strings of an axiomatic formal system; albeit this sytem is a "time domain system" and not an arithmetic systems in the usual sense of the classic number theory. Indeed, said formal system shows at least one axiom and derives from it continuous strings of numbers through the application of a certain algorithm. Regarding TURING, an axiomatic number theoretical system can be produced also by a mechanical procedure, which produces "formulas and algorithms". For his reason, the known logic theorems of GOEDEL, TARSKI or HENKIN are absolutely applicable on such a model. GOEDEL's incompleteness theorem shows that each extensive number theoretical model includes consistent formulations which cannot be proven with the rules of the model, and which therefore are undecidable. This is valid also to metatheoretical models and to meta-metatheoretical models etc.

For example, a self-referential metatheoretical sentence like the type of the Goedel formulation <I am provable> is neither provable nor disprovable. A decision procedure for this proposition leads to an infmite regress. TARSKI showed that a decision procedure for number theoretical "truth" is also impossible, and leads to an infinite regress. Thus, a self-referential sentence of the type <I am provable> is admittedly "true", but not "provable". It follows, that "provability" is a stronger term than "truth". HENKIN showed that there are sentences, that assert their own provability and "producibility" in a specific number theoretical model and which are invariable "true". A self-referential sentence based on Henkins theorem would be: <It exists a number theoretical model in which I am provable>. Strings of quantized elapse times like TΩ and TΩ' approach the domain of validity of HENKIN's theorem. Applying Henkin's logic, these strings assert: <I will be produced to be proved>. TΩ and TΩ's are therefore strings or sentences that are produced in a specific formal model, which induces its own decision procedure on truth, consistence, completeness and provability through continued self-generation (see also description to FIG. 10).

In contrast to self-referential strings or sentences of the G ödel or Henkin type, strings of elapse times are never asserted to be "true", "consistent", "complete " or "provable" to a certain "point in time", because within the "number theoretical model" in which they are produced, no "points of time" exist. This model also prohibits superior semantics or metatheories or metametatheories. It is plainly obvious that each formal system, each metatheory, each meta-metatheory and each semantics, in which axioms, strings or sentences of any type are formulated, is the result of continued autonomous adaptation (which is based on the quantization of elapse times) and therefore a derivation of the model described in this work.

4) The cognition, that a specific formal system exists asserting absolute universal validity, from which everything has been produced and to whom all other systems have to be subordinated, is not new. Already in early antiquity, many years before PLATO and ARISTOTLE, the Hebrew Scriptures (2. Moses 3: 14) let this <source of all logic> say from itself: "JHWH" (spoken: Jahwe or Jehovah), that is about: "I shall be proved". This sentence asserts its own decision procedure on provability, truth, completeness and consistence; trough a specific formal system, that it "induces to be".

5) There is no "cognition" without "recognition".

What is claimed is:

1. A method to generate recognition, auto-adaptation and self-organizing processes in autonomous systems, including the steps of:

a) providing a device for sensing the temporal-spatial variations between the physical state of said system and the physical state of the surroundings of said system, the device comprising:

sensor means coupled to said system to produce analog signals;

receiving means connected to said sensor means to receive said analog signals;

threshold value detector means connected to said receiving means to classify said received;

analog signals into classes according to signal amplitudes;

time recording means connected to said threshold value detector means to record elapse times;

time analyzing means connected to said time recording means;

b) recording the current elapse times between phase transitions through said threshold values, c) analyzing said elapse times to find covariant elapse time sequences within currently recorded elapse times, said elapse time sequences being covariant with sequences of prior recorded elapse times.

2. A method as set forth in claim 1, including the further steps of:

providing a sub-device to control the motions of said autonomous system, the device comprising:

control means programmed by said covariant elapse time sequences found by said analyzing means;

motion actuator means regulated by said control means.

3. A method as set forth in claim 2, wherein said found covariant elapse time sequence program said control means for the regulation of said motion actuator means, whereby said autonomous system in motion is prompted to emulate said covariant elapse time sequences.

4. A method as set forth in claims 3, wherein said motion actuator means comprise propulsion means, braking means and steering means.

5. A method as set forth in claim 1, wherein said time recording means record the time counting pulses used in the acquisition of those elapse times that represent the variations between the physical state of said system and the physical state of the surroundings of said system.

6. A method as set forth in claim 5, wherein said time recording means additionally record the time counting pulses used in the acquisition of those elapse times that represent the velocity of said system relative to said physical surroundings.

7. A method as set forth in claim 6, wherein the frequency of said time counting pulses used in the acquisition of those elapse times that represent the variations between the physical state of said system is continually adapted to the velocity of said system relative to the physical surroundings.

8. A method as set forth in claim 5, wherein the time base frequency for said elapse time recording is increased or decreased in order to scale the time values in the sequences of said elapse times, whereby the velocity of the emulated motion of said system is scaled proportionally.

9. A method as set forth in claim 1, wherein said autonomous system comprises a molecular/biological organism.

10. A method as set forth in claim 3, wherein said autonomous system comprises a robot vehicle.

11. A method as set forth in claim 4, wherein said autonomous system comprises a sports training vehicle.

* * * * *